US005805187A

United States Patent [19]

Sasaki

[11] Patent Number: 5,805,187

[45] Date of Patent: Sep. 8, 1998

[54] INK JETTING APPARATUS AND CARTRIDGE FOR USE THEREWITH

[75] Inventor: Toyonori Sasaki, Anjo, Japan

[73] Assignee: Brother Kogyo Kabushiki Kaisha, Nagoya, Japan

[21] Appl. No.: 574,319

[22] Filed: Dec. 18, 1995

[30] Foreign Application Priority Data

Dec. 27, 1994 [JP] Japan ..... 6-325285

[51] Int. Cl.[6] ..... B41J 2/175

[52] U.S. Cl. ..... 347/86

[58] Field of Search ..... 347/85, 86, 87, 347/103, 104

[56] References Cited

U.S. PATENT DOCUMENTS

| | | | |
|---|---|---|---|
| 4,628,334 | 12/1986 | Dagna et al. | 347/86 |
| 5,504,512 | 4/1996 | Shimoda et al. | 347/86 |
| 5,574,489 | 11/1996 | Cowger et al. | 347/86 |
| 5,666,146 | 9/1997 | Mochizuki et al. | 347/86 |

*Primary Examiner*—Matthew V. Nguyen
*Attorney, Agent, or Firm*—Oliff & Berridge, PLC

[57] ABSTRACT

An ink jetting apparatus including a cartridge including an ink container which contains an ink therein, a movable cartridge holder to which the cartridge is detachably attached, and a moving device which moves the cartridge holder, the cartridge holder having a first cartridge-side surface which extends substantially parallel to a direction of movement thereof by the moving device, the cartridge having a first holder-side surface which is opposed to the first cartridge-side surface, the cartridge holder having, in the first cartridge-side surface thereof, one of a first engageable projection and a first engageable hole, the cartridge having, in the first holder-side surface thereof, the other of the first engageable projection and the first engageable hole, the first engageable projection and the first engageable hole having respective shapes and respective dimensions which ensure that while the first engageable projection is engaged with the first engageable hole, the cartridge is substantially immovable relative to the cartridge holder in the direction of movement of the cartridge holder.

34 Claims, 19 Drawing Sheets

INK JETTING APPARATUS AND CARTRIDGE FOR USE THEREWITH

BACKGROUND OF THE INVENTION

1. Field of the Invention

The present invention relates to an ink jetting apparatus and a cartridge for use therewith and particularly to the art of accurately positioning the cartridge relative to a cartridge holder of the ink jetting apparatus.

2. Related Art Statement

There is known an ink jetting device which jets ink toward a recording medium while moving relative to the recording medium. Generally, a known ink jetting device includes (a) a cartridge which includes at least an ink container, (b) a cartridge holder to which the cartridge is detachably attached, and (c) a moving device which moves the cartridge holder. An ink jetting head is provided as an integral part of the cartridge holder or the ink container. At any rate, it is required that the cartridge being attached to the cartridge holder be prevented from moving out of position relative to the cartridge holder while the cartridge holder is moved by the moving device.

The ink jetting device is employed by, e.g., an ink-jet printer. In the case of an ink jetting device wherein an ink jetting head is provided as part of a cartridge holder and, when a cartridge is attached to the cartridge holder, an ink outlet of an ink container of a cartridge is connected to the ink jetting head, moving of the cartridge out of position on the cartridge holder in a direction of movement of the cartridge holder may lead to leaking of the ink from the ink container because of moving of the ink outlet out of position relative to the ink jetting head. Meanwhile, in the case of an ink jetting device wherein an ink jetting head is provided as part of a cartridge, the above-indicated moving of the cartridge out of position on the cartridge holder may result in recording of images at inaccurate positions on a recording medium.

In a known movable ink jetting device which is employed in an ink-jet printer and which jets ink vertically downward, the moving of a cartridge out of position relative to a cartridge holder in a holder-movement direction is prevented by fitting of the cartridge in the cartridge holder. The cartridge holder has a container-like shape having a rectangular cross section and opening upward, and the ink jetting head is provided in a bottom wall of the cartridge holder. The cartridge holder has an engageable wall which is provided adjacent to the opening thereof and extends perpendicularly to the holder-movement direction. The engageable wall has an engageable hole which is formed through a thickness thereof and extends parallel to the holder- movement direction. The cartridge has a rectangular cross section, and has an engageable pin which projects from a side wall thereof extending perpendicular to the holder-movement direction. The cartridge is inserted into the opening of the cartridge holder while taking a vertical position in which a front portion thereof is lower than a rear portion thereof, and is fitted in the cartridge holder while the engageable pin thereof elastically deforms the engageable wall of the cartridge holder outward. In the state in which the ink container of the cartridge is connected to the ink jetting head, the engageable pin is engaged with the hole of the engageable wall. Thus, the cartridge is prevented from moving out of position relative to the cartridge holder in a vertical direction and a direction perpendicular to the holder-movement direction. In addition, because in the same state the cartridge is engaged with two opposite side walls of the cartridge holder which walls extend perpendicularly to the holder-movement direction, the cartridge is prevented from moving relative to the cartridge holder in the holder-movement direction.

However, even though the cartridge may be prevented to some extent from moving relative to the cartridge holder in the holder-movement direction because of the engagement thereof with the two side walls of the cartridge holder, there remains some clearance between the cartridge and the cartridge holder in the holder-movement direction which clearance is needed to permit the user to easily insert the cartridge into the cartridge holder. Thus, the known ink jetting device is not fully free from the problem that the cartridge may be moved out of position relative to the cartridge holder in the holder-movement direction.

The above problem applies to a movable ink jetting device which jets ink in a horizontal direction, and a cartridge which is used with the ink jetting device.

SUMMARY OF THE INVENTION

It is therefore a first object of the present invention to provide an ink jetting apparatus which includes a cartridge and a cartridge holder for holding the cartridge such that the cartridge is effectively prevented from moving out of position relative to the cartridge holder in a direction of movement of the cartridge holder.

It is a second object of the present invention to provide a cartridge for use with an ink jetting apparatus which cartridge can be attached to a cartridge holder of the ink jetting apparatus such that, while the cartridge is moved, the cartridge is effectively prevented from moving out of position relative to the cartridge holder.

The above first object has been achieved according to a first aspect of the present invention, which provides an ink jetting apparatus comprising at least one cartridge including at least an ink container which contains an ink therein; at least one movable cartridge holder to which the cartridge is detachably attached; and a moving device which moves the cartridge holder, the cartridge holder having a first cartridge-side surface which extends substantially parallel to a direction of movement thereof by the moving device, the cartridge having a first holder-side surface which is opposed to the first cartridge-side surface, the cartridge holder having, in the first cartridge-side surface thereof, one of a first engageable projection and a first engageable hole, the cartridge having, in the first holder-side surface thereof, the other of the first engageable projection and the first engageable hole, the first engageable projection and the first engageable hole having respective shapes and respective dimensions which ensure that while the first engageable projection is engaged with the first engageable hole, the cartridge is substantially immovable relative to the cartridge holder in the direction of movement of the cartridge holder. As far as the present invention is concerned, what is meant by the wording "substantially parallel to a direction of movement (of the cartridge holder by the moving device)" should encompass the following two cases: the first case is such that the first cartridge-side surface extends in a plane parallel to the direction of movement of the cartridge holder and the second case is such that the first cartridge-side surface extends in a plane which is inclined by a small angle for some reason with respect to the direction of movement of the cartridge holder. In the case where the moving of the cartridge out of position relative to the cartridge holder is prevented by the engagement of a single first engageable projection and a single first engageable hole, it is preferred that those projection and hole be elongate in a direction substantially perpendicular to the holder-movement direction. Otherwise, the moving of the cartridge out of position relative to the cartridge holder may be prevented by the engagement of a single, elongate first engageable hole and a plurality of first engageable projections.

In the ink jetting apparatus constructed as described above, the first engageable projection and hole are engaged with each other when the cartridge is attached to the cartridge holder, so that the cartridge is prevented from moving out of position relative to the cartridge holder in the direction of movement of the cartridge holder. The first engageable projection and hole are formed with high accuracy so that while the projection and hole are engageable with each other, the cartridge is substantially immovable relative to the cartridge holder in the holder-movement direction. In the case where the moving device for moving the cartridge holder moves a carriage to which the cartridge holder is detachably attached, the first engageable projection (or hole) may be provided on the cartridge holder or the carriage. In the latter case, the cartridge provides part of the cartridge holder. In the present ink jetting apparatus, the moving of the cartridge relative to the cartridge holder in the holder-movement direction is effectively prevented by the engagement of the first engageable projection and hole. Thus, the ink jetting apparatus is free from the problems that the ink container fails to supply the ink to the ink jetting head, or the ink jetting head fails to record images at accurate positions on a recording medium, because of the moving of the cartridge out of position on the cartridge holder.

According to a preferred feature of the first aspect of the invention, the cartridge holder has a second cartridge-side surface which extends substantially parallel to the direction of movement thereof, and the cartridge has a second holder-side surface which is opposed to the second cartridge-side surface, the cartridge holder having, in the second cartridge-side surface thereof, one of a second engageable projection and a second engageable hole, the cartridge having, in the second holder-side surface thereof, the other of the second engageable projection and the second engageable hole, the second engageable projection and the second engageable hole having respective shapes and respective dimensions which ensure that while the second engageable projection is engaged with the second engageable hole, the cartridge is substantially immovable relative to the cartridge holder in the direction of movement thereof. In this case, when the cartridge is attached to the cartridge holder, the first engageable projection and hole are engaged with each other, and additionally the second engageable projection and hole are engaged with each other, so that owing to the two engagements the cartridge is more effectively prevented from moving out of position relative to the cartridge holder in the holder-movement direction. The second cartridge-side surface may be present in the same plane as, or a different plane from, that in which the first cartridge-side surface is present. Similarly, the second holder-side surface may be present in the same plane as, or a different plane from, that in which the first holder-side surface is present. In the case where the first and second cartridge-side or holder-side surfaces are present in a common plane, the two surfaces may be continuous with, or discontinuous from, each other. In the case where the first and second cartridge-side or holder-side surfaces are present in two different planes, respectively, the two planes may extend parallel to each other, or intersect each other at, e.g., a right angle. The first or second engageable projection and hole may be provided by a single projection and a single hole, a plurality of projections and a plurality of holes, a single projection and a plurality of holes, or a plurality of projections and a single hole, respectively. Whether the first and second cartridge-side or holder-side surfaces may be present in a common plane, or in different planes, respectively, it is preferred for the purpose of preventing the moving of the cartridge out of position relative to the cartridge holder that the first engageable projection and hole and the second engageable projection and hole be located at respective positions which are remote from each other in a direction perpendicular to the holder-movement direction. However, the first projection and hole and the second projection and hole may be located at respective positions which are remote from each other in the holder-movement direction. In the case where the first projection and hole and the second projection and hole are located at respective positions which are remote from each other in a direction perpendicular to the holder-movement direction and the first projection and hole and/or the second projection and hole are provided by a plurality of projections and a plurality of holes, it is preferred that the projections and holes be located at respective positions which are remote from each other in the holder-movement direction. In the present ink jetting apparatus, the moving of the cartridge relative to the cartridge holder in the holder-movement direction is more effectively prevented by both the engagement of the first engageable projection and hole and the engagement of the second engageable projection and hole.

According to another feature of the first aspect of the invention, the first engageable projection and hole are located away from the second engageable projection and hole in a perpendicular direction perpendicular to the movement direction of the cartridge holder. In this case, the out-of-position moving of the cartridge relative to the cartridge holder is more effectively prevented because the cartridge is securely positioned at two positions which are remote from each other in the direction perpendicular to the movement direction of the cartridge holder.

According to another feature of the first aspect of the invention, a distance between the first engageable projection and hole and the second engageable projection and hole in the perpendicular direction is greater than a dimension of the cartridge in the movement direction. In this case, the out-of-position moving of the cartridge relative to the cartridge holder is most effectively prevented.

According to another feature of the first aspect of the invention, the cartridge holder comprises an ink-jetting head which jets the ink supplied from the ink container of the cartridge. Alternatively, the cartridge may comprise an ink-jetting head which jets the ink supplied from the ink container.

According to another feature of the first aspect of the invention, the first engageable projection has a part-cylindrical top surface and extends in a direction perpendicular to the movement direction of the cartridge holder. This projection is easily engageable with the first engageable hole and, while being engaged with the hole, effectively functions for preventing the moving of the cartridge relative to the cartridge holder. In addition, this projection is easily formed or obtained by using a forming metallic mold having a recess having a part-cylindrical bottom surface.

According to another feature of the first aspect of the invention, the first engageable hole has a part-cylindrical bottom surface and extends in a direction perpendicular to the movement direction of the cartridge holder. This hole is easily engageable with the first engageable projection and, while being engaged with the projection, effectively functions for preventing the moving of the cartridge relative to the cartridge holder. In addition, this hole is easily formed or obtained by machining the cartridge or the cartridge holder.

According to another feature of the first aspect of the invention, the first engageable projection and hole are located at respective middle positions of the cartridge holder and the cartridge in the movement direction of the cartridge holder. In this case, the moving of the cartridge relative to the cartridge holder is effectively prevented by the engagement of a single first engageable projection and a single first engageable hole.

According to another feature of the first aspect of the invention, the first engageable hole is provided in the first holder-side surface of the cartridge, and the second engageable projection is provided in the second holder-side surface of the cartridge.

According to another feature of the first aspect of the invention, the cartridge holder comprises an ink-jetting head which jets the ink supplied from the ink container of the cartridge detachably attached to the cartridge holder; a head supporting portion which supports the ink-jetting head; a connecting device which is supported by the head supporting portion and which connects between the ink-jetting head and an ink outlet of the ink container of the cartridge; and a cartridge holding portion which extends from the head supporting portion in a first plane intersecting a second plane in which the head supporting portion extends and which holds the cartridge such that the cartridge is detachable from the cartridge holder.

According to another feature of the first aspect of the invention, the first cartridge-side surface comprises a cartridge-side surface of the cartridge holding portion of the cartridge holder which surface is opposed to the cartridge, and the second cartridge-side surface comprises a cartridge-side surface of the head supporting portion of the cartridge holder which surface is opposed to the cartridge.

According to another feature of the first aspect of the invention, a distance between the head supporting portion and the first engageable projection and hole in a direction in which the cartridge holding portion extends from the head supporting portion is larger than a dimension of the cartridge in the movement direction of the cartridge holder.

According to another feature of the first aspect of the invention, the second engageable hole has an inner dimension in a perpendicular direction perpendicular to the movement direction of the cartridge holder and a direction of jetting of the ink by the ink-jetting head, the inner dimension decreasing in a direction of depth of the second engageable hole from an opening thereof through which the second engageable projection is engageable therewith.

According to another feature of the first aspect of the invention, the second engageable hole is provided in the cartridge-side surface of the head-supporting portion of the cartridge holder, and has a side wall surface which is continuous with the cartridge-side surface of the cartridge holding portion of the cartridge holder and is inclined with respect to the cartridge-side surface of the cartridge holding portion so as to gradually climb up in the perpendicular direction.

According to another feature of the first aspect of the invention, the apparatus further comprises a carriage which is movable by the moving device; and a clamping device which clamps the cartridge holder to the carriage such that the cartridge holder is detachable from the carriage.

According to another feature of the first aspect of the invention, the second engageable projection comprises two projections which laterally project from two side surfaces adjacent to the first and second holder-side surfaces of the cartridge and extend over the second holder-side surface toward the head supporting portion of the cartridge holder.

According to another feature of the first aspect of the invention, the at least one cartridge comprises a plurality of cartridges, and the at least one movable cartridge holder comprises a plurality of movable cartridge holders to which the cartridges are detachably attached, respectively, and which are mounted on the moving device such that an array of the cartridge holders extends parallel to a direction of movement thereof by the moving device, each of the cartridge holders having the one of the first engageable projection and hole which is provided in the first cartridge-side surface thereof at a corresponding one of a plurality of different first positions in the direction of movement, each of the cartridges including the other of the first engageable projection and hole which is provided in the first holder-side surface thereof at a corresponding one of a plurality of different second positions in the direction of movement which correspond to the first positions, respectively. In the present ink jetting apparatus, each of a plurality of different sorts of cartridges containing a plurality of different sorts of color inks, respectively, can be attached to only the correct or appropriate cartridge holder that has a first projection or hole at a second position corresponding to a first position at which the cartridge holder has a first hole or projection. Accordingly, each cartridge must be attached to a correct or appropriate position on the moving device in the holder-movement direction. This arrangement is needed by, e.g., an ink jetting apparatus of a full-color ink-jet printer. This ink jetting apparatus has four ink containers which contain cyan, magenta, yellow, and black color inks, respectively, and four ink jetting heads which jet the color inks supplied from the ink containers, respectively. The ink jetting apparatus records full-color images on a recording medium by jetting, from the ink jetting heads, one or more color inks toward the recording medium. A control device is programmed to select, at each instant, one or more of the four heads and control the selected head or heads to jet the ink or inks toward the recording medium. The control device selects each head according to the position thereof on the moving device in the holder-movement direction. Therefore, if an ink container is placed at an incorrect position on the moving device, an incorrect color ink different from a correct color ink in accordance with image data is jetted to record images on the recording medium. To avoid this, the cartridge holders have respective first projections or holes at different first positions, respectively, and the cartridges have respective first holes or projections at different second positions, respectively, which correspond to the first positions, respectively. In addition, each ink jetting head is effectively prevented from jetting different color inks mixed with each other, when ink containers are changed with each other. In the case where each cartridge holder has an ink jetting head, even if that cartridge holder may be changed with a new one, the other cartridge holders with the respective ink jetting heads need not be changed. Thus, this leads to reducing the running cost of the ink jetting apparatus. However, it is not essentially required to provide a cartridge holder for each of the cartridges, and it is possible to provide a single cartridge holder which holds a plurality of cartridges. This arrangement is described below.

According to another feature of the first aspect of the invention, the at least one cartridge comprises a plurality of cartridges which are respectively detachably attached to a plurality of cartridge holding portions of the movable cartridge holder which is mounted on the moving device, each of the cartridge holding portions of the cartridge holder having the one of the first engageable projection and hole which is provided at a corresponding one of a plurality of different first positions in the direction of movement of the cartridge holder, each of the cartridges including the other of the first engageable projection and hole which is provided in the first holder-side surface thereof at a corresponding one of a plurality of different second positions in the direction of movement which correspond to the first positions, respectively. In the present ink jetting apparatus, too, each cartridge must be attached to a correct or appropriate position on the moving device in the holder-movement direction. The single cartridge holder is more quickly and easily attached to the moving device. In addition, the moving device enjoys a simpler construction.

The above second object has been achieved according to a second aspect of the present invention, which provides a cartridge for use with an ink-jetting apparatus, the cartridge including at least an ink container containing an ink therein, and being detachably attached to a cartridge holder which is moved by a moving device along a surface of a recording medium, the cartridge holder having a first cartridge-side surface extending substantially parallel to a direction of movement thereof by the moving device, the cartridge holder having, in the first cartridge-side surface thereof, one of a first engageable projection and a first engageable hole, wherein the improvement comprises the cartridge having a first holder-side surface which is opposed to the first cartridge-side surface of the cartridge holder, the cartridge including, in the first holder-side surface thereof, the other of the first engageable projection and the first engageable hole.

In the cartridge constructed as described above, the first engageable projection and hole are engaged with each other, when the cartridge is attached to the cartridge holder. Thus, the cartridge is prevented from moving out of position relative to the cartridge holder in the direction of movement of the cartridge holder, when the cartridge holder to which the cartridge is attached is moved by the moving device.

According to a preferred feature of the second aspect of the invention, in the case where the cartridge holder has a second cartridge-side surface which extends substantially parallel to the direction of movement of the cartridge holder, and has, in the second cartridge-side surface thereof, one of a second engageable projection and a second engageable hole, the cartridge has a second holder-side surface which is opposed to the second cartridge-side surface of the cartridge holder, and has, in the second holder-side surface thereof, the other of the second engageable projection and the second engageable hole. In this case, when the cartridge is attached to the cartridge holder, the first engageable projection and hole are engaged with each other, and additionally the second engageable projection and hole are engaged with each other. Owing to the two engagements, the cartridge is more effectively prevented from moving out of position relative to the cartridge holder in the holder-movement direction.

According to another feature of the second aspect of the invention, the first engageable projection and hole are located away from the second engageable projection and hole in a perpendicular direction perpendicular to the movement direction of the cartridge holder.

According to another feature of the second aspect of the invention, a distance between the first engageable projection and hole and the second engageable projection and hole in the perpendicular direction is greater than a dimension of the cartridge in the movement direction.

According to another feature of the second aspect of the invention, the first engageable projection has a part-cylindrical top surface and extends in a direction perpendicular to the movement direction of the cartridge holder.

According to another feature of the second aspect of the invention, the first engageable hole has a part-cylindrical bottom surface and extends in a direction perpendicular to the movement direction of the cartridge holder.

According to another feature of the second aspect of the invention, the first engageable projection and hole are located at respective middle positions of the cartridge holder and the cartridge in the movement direction of the cartridge holder.

According to another feature of the second aspect of the invention, the first engageable hole is provided in the first holder-side surface of the cartridge, and the second engageable projection is provided in the second holder-side surface of the cartridge.

According to another feature of the second aspect of the invention, in the case where the cartridge holder includes a cartridge holding portion holding the cartridge such that the cartridge is detachable from the cartridge holder, and a head supporting portion supporting an ink-jetting head which jets the ink supplied from the ink container of the cartridge, the first holder-side surface is opposed to a cartridge-side surface of the cartridge holding portion of the cartridge holder and the second holder-side surface is opposed to a cartridge-side surface of the head supporting portion of the cartridge holder.

According to another feature of the second aspect of the invention, the second engageable projection extends over the second holder-side surface toward the cartridge holder.

According to another feature of the second aspect of the invention, the second engageable projection comprises two projections provided at opposite end portions of the second holder-side surface of the cartridge in the movement direction of the cartridge holder.

According to another feature of the second aspect of the invention, the second engageable projection is provided at one of opposite end portions of the second holder-side surface of the cartridge in a direction perpendicular to the movement direction of the cartridge holder, the one end portion being nearer to the cartridge-side surface of the cartridge holding portion of the cartridge holder, than the other end portion.

According to another feature of the second aspect of the invention, one of opposite surfaces of the second engageable projection which is opposed to the second cartridge-side surface of the cartridge holder is flush with the first holder-side surface of the cartridge which is opposed to the first cartridge-side surface of the cartridge holder.

According to another feature of the second aspect of the invention, the cartridge comprises at least one abutable projection projecting from the first holder-side surface thereof which is opposed to the cartridge-side surface of the cartridge holding portion of the cartridge holder, the abutable projection being abutable on the cartridge-side surface of the cartridge holding portion, a projection amount of the abutable projection from the first holder-side surface of the cartridge being predetermined such that when the abutable projection is held in abutment on the cartridge-side surface of the cartridge holding portion, one of opposite surfaces of the second engageable projection which surface is opposite to the other surface thereof opposed to the cartridge-side surface of the cartridge holding portion, is substantially flush with a corresponding one of opposite side wall surfaces of the second engageable hole.

According to another feature of the second aspect of the invention, the second engageable projection comprises two projections which laterally project from two side surfaces adjacent to the first and second holder-side surfaces of the cartridge and extend over the second holder-side surface toward the head supporting portion of the cartridge holder.

According to a third aspect of the present invention, there is provided a combination of a plurality of cartridges each according to the second aspect of the invention, wherein the improvement comprises each of the plurality of cartridges having the other of the first engageable projection and hole which is provided in the first holder-side surface thereof at a corresponding one of a plurality of different positions in the movement direction of the cartridge holder, so that the movement-direction position of the other of the first engageable projection and hole of one of the cartridges is different from the movement-direction position of the other of the first engageable projection and holes of the other, or each of the others, of the cartridges. Each cartridge must be attached to a correct or appropriate position on the moving device in the holder-movement direction. In the case where each cartridge has a first engageable projection or hole and a second projection projection or hole, it is possible to provide the respective second projections or holes of the cartridges at different positions in the holder-movement direction, as is the case with the first projections or holes. In the latter case, more sorts of ink containers can securely be attached to respective correct positions on the moving device, by combining the different positions of the first projections or holes and the different positions of the second projections or holes. This arrangement is advantageous, e.g., in the case where the dimension of each ink container is very small and it is difficult or impossible to provide two or more different positions at which first projections or holes are formed. In the latter case, two or more sorts of cartridges can be combined together by providing two or more different positions at which second projections or holes are formed.

BRIEF DESCRIPTION OF THE DRAWINGS

The above and optional objects, features, and advantages of the present invention will better be understood by reading the following detailed description of the preferred embodiments of the invention when considered in conjunction with the accompanying drawings, in which.

DETAILED DESCRIPTION OF THE PREFERRED EMBODIMENTS

Figure 1:
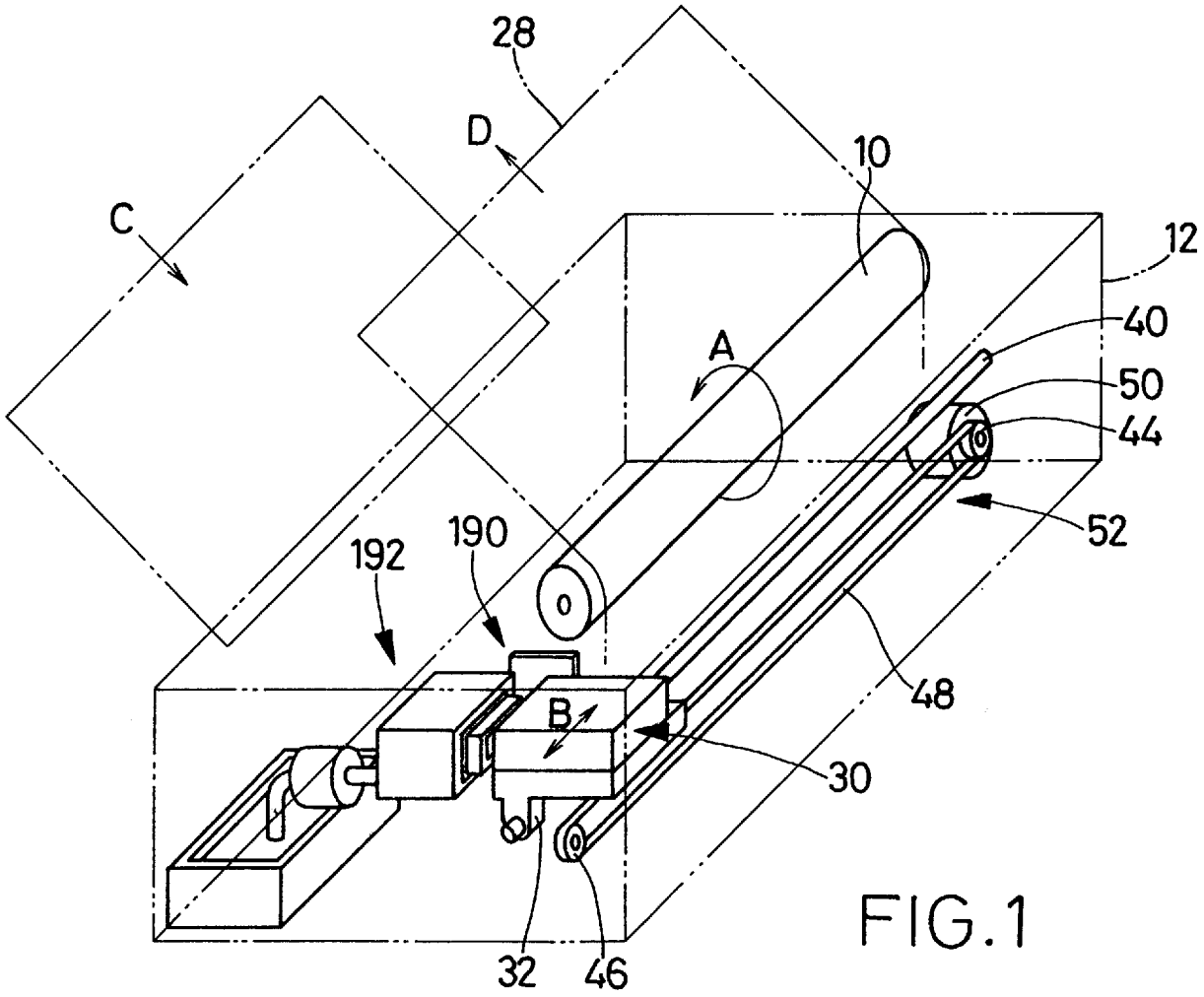
FIG. 1 is a perspective view of an ink-jet printer including an ink jetting apparatus and a cartridge for use therewith to which the present invention is applied.

Referring first to FIG. 1, there is shown an ink-jet printer including an ink jetting apparatus 30 and a cartridge for use therewith to which the present is applied. The cartridge includes an ink container 82 shown in FIG. 2.

In FIG. 1, reference numeral 10 designates a platen which has a cylindrical shape and is elongate along an axis line of rotation thereof. The ink-jet printer has a casing 12 which supports the platen 10 via a shaft member (not shown) such that the platen 10 is rotatable about the axis line thereof. The casing 12 is part of a frame member of the printer.

The platen 10 is rotated by a platen rotating device (not shown), in a direction indicated at arrow, A, in FIG. 1, so as to feed a recording sheet as a recording medium in a direction indicated at arrow, D. The recording sheet 28 is supplied in a direction indicated at arrow, C, through a sheet inlet (not shown) provided in a rear portion of the casing 12, is fed forward by the rotation of the platen 10, and is output through a sheet outlet (not shown).

Figure 2:
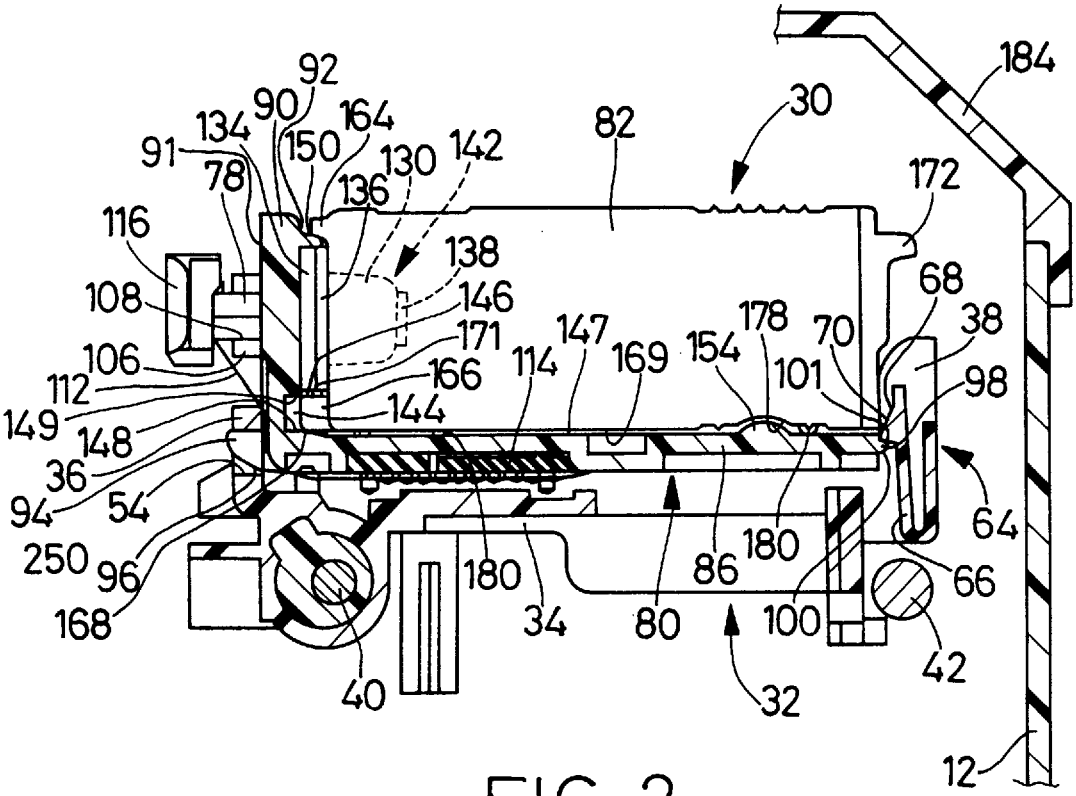
FIG. 2 is a cross-sectional elevation view of the ink jetting apparatus of FIG. 1 being mounted on a carriage of the ink-jet printer of FIG. 1.

An ink jetting apparatus 30 is opposed to the platen 10. The ink jetting apparatus 30 is mounted on a carriage 32. As shown in FIG. 2, the carriage 32 has a bottom wall 34, a front wall 36, and a rear wall 38. The front and rear walls 36, 38 extend upward from a front end and a rear end of the bottom wall 34. The carriage 32 is slidably fitted on a guide rod 40 which extends parallel to the axis line of rotation of the platen 10, in front of a lower surface of the bottom wall 34. The carriage 32 is engaged, at a rear end of the bottom wall 34 thereof, with a guide rail 42 (omitted in FIG. 1).

In the following description, the wording "front-rear direction" will be referred to as a direction parallel to a direction of jetting of ink by the ink jetting apparatus 30. As far as the ink jetting apparatus 30 or the carriage 32 is concerned, a front and a rear portion thereof will be referred to as a downstream-side and an upstream-side portion thereof as viewed in the ink jetting direction, respectively. The ink jetting apparatus 30 of the present ink-jet printer is of a type which jets ink in a horizontal direction and thereby records images such as letters, symbols, etc. on the recording sheet 28 retained on the platen 10. Therefore, the "front-rear direction" used in the following description is a horizontal direction. Conversely, however, as far as the ink-jet printer as a whole is concerned, a front and a rear portion thereof are an upstream-side and a downstream-side portion thereof as viewed in the ink-jetting direction, respectively.

Since in the present ink-jet printer the ink jetting direction is a horizontal direction as described above, a vertical direction is perpendicular to both the ink jetting direction and a direction of movement of the ink jetting apparatus 30 relative to the platen 10, i.e., direction of width of the ink-jet printer.

As shown in FIG. 1, the carriage 32 is fixed to a cog belt 48 which is wound around a pair of pulleys 44, 46. When one 44 of the pulleys 44, 46 is rotated by a carriage drive motor 50 so as to feed the cog belt 48, the carriage 32 is fed along the platen 10 in a direction indicated at arrow, B. The two pulleys 44, 46, cog belt 48, and carriage drive motor 50 cooperate with one another to provide a carriage drive device 52.

Recording of images is carried out on the sheet 28 by reciprocating the carriage 32 with the ink jetting apparatus 30, within a predetermined recording area or range along the platen 10. After the recording ends, the carriage 32 is moved to a non-recording or waiting area provided beyond one of opposite ends of the recording area in the movement direction of the carriage 32. Within the recording area, the carriage 32 is moved at a predetermined speed so that the recording can be performed with uniformity. That is, the recording area is a constant-speed area. There are additionally provided two acceleration-deceleration areas on both sides of the constant-speed area. Within the acceleration-deceleration areas, the carriage 32 is accelerated or decelerated when being started, stopped, or returned. Thus, the acceleration-deceleration areas are ones of the non-recording areas of the in-jet printer.

As shown in FIG. 1, in the waiting area as one of the non-recording areas of the ink-jet printer, there are provided an ink-jetting-head cleaning device 190 and an ink-jetting-head capping device 192 in series with the platen 10 in the movement direction of the carriage 32. The cleaning device 190 cleans an ink jetting head 78 (described later) of the ink remaining on an ink jetting surface thereof. The capping device 192 caps or covers the ink jetting surface of the ink jetting head 78 being not in use, thereby preventing drying up of ink jetting nozzles and preventing dust or the like from entering the nozzles or ink passages of the head 78. However, those devices 190, 192 are not pertinent to the present invention, and detailed description thereof is omitted.

Figure 3:
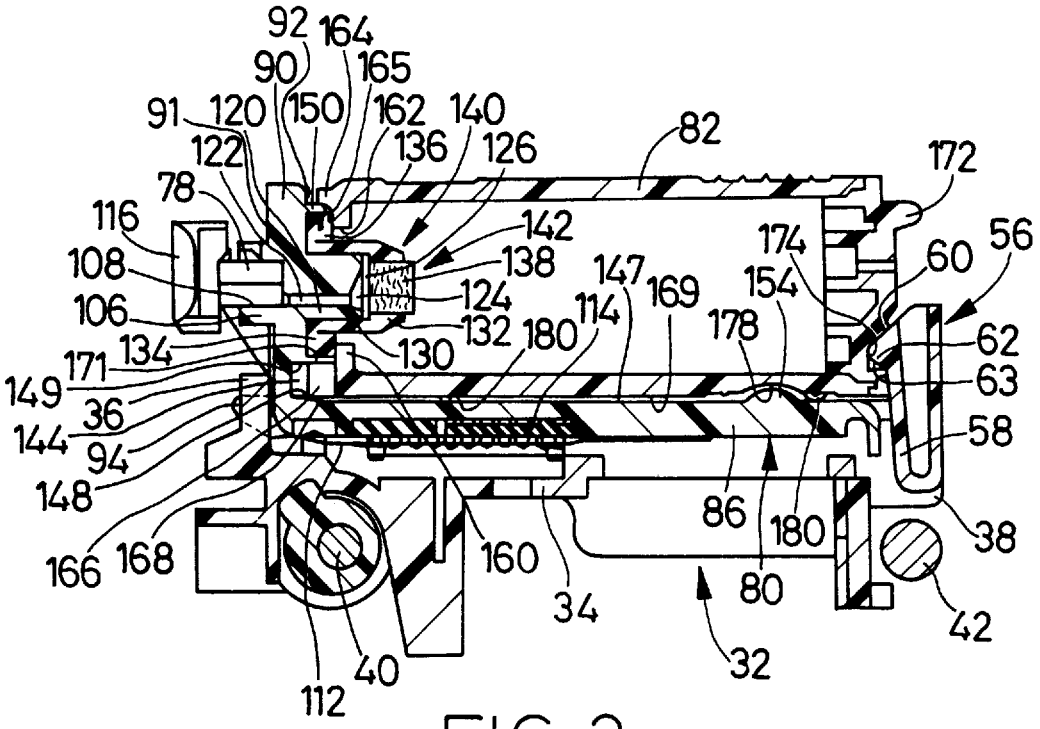
FIG. 3 is another cross-sectional elevation view of the ink jetting apparatus of FIG. 1 being mounted on the carriage of the ink-jet printer of FIG. 1.
Figure 4:
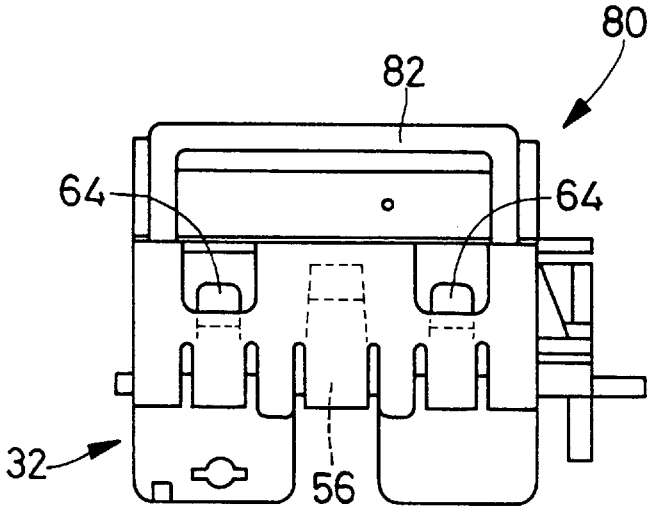
FIG. 4 is a rear view of the ink jetting apparatus of FIG. 1.

The carriage 32 has two engageable holes 54 which are formed through the thickness of the front wall 36 of the carriage 32 in the front-rear direction such that the two holes 54 are remote from each other in the movement direction of the carriage 32 (only one 54 is shown in FIG. 1). As shown in FIG. 4, an ink-container hook 56 is provided in an intermediate portion of the rear wall 38 of the carriage 32 in the movement direction thereof. As shown in FIG. 3, the ink-container hook 56 has a U shape and opens upward. The ink-container hook 56 includes a front arm 58 which has, in an upper end portion thereof, an engageable projection 62 with an inclined top surface 60 and an inclined bottom surface 63. The top surface 60 is inclined frontward and downward, i.e., rearward and upward, and the bottom surface 63 is inclined frontward and upward, i.e., rearward and downward.

As shown in FIG. 4, in the rear wall 38 of the carriage 32, there are provided two head-holder hooks 64 on both sides of the ink-container hook 56 in the movement direction of the carriage 32. As shown in FIG. 2, the head-holder hooks 64 have a U shape and open upward. Each of the head-holder hooks 64 includes a front arm 66 which has an engageable projection 70 with an inclined top surface 68 which is inclined frontward and downward.

Figure 5:
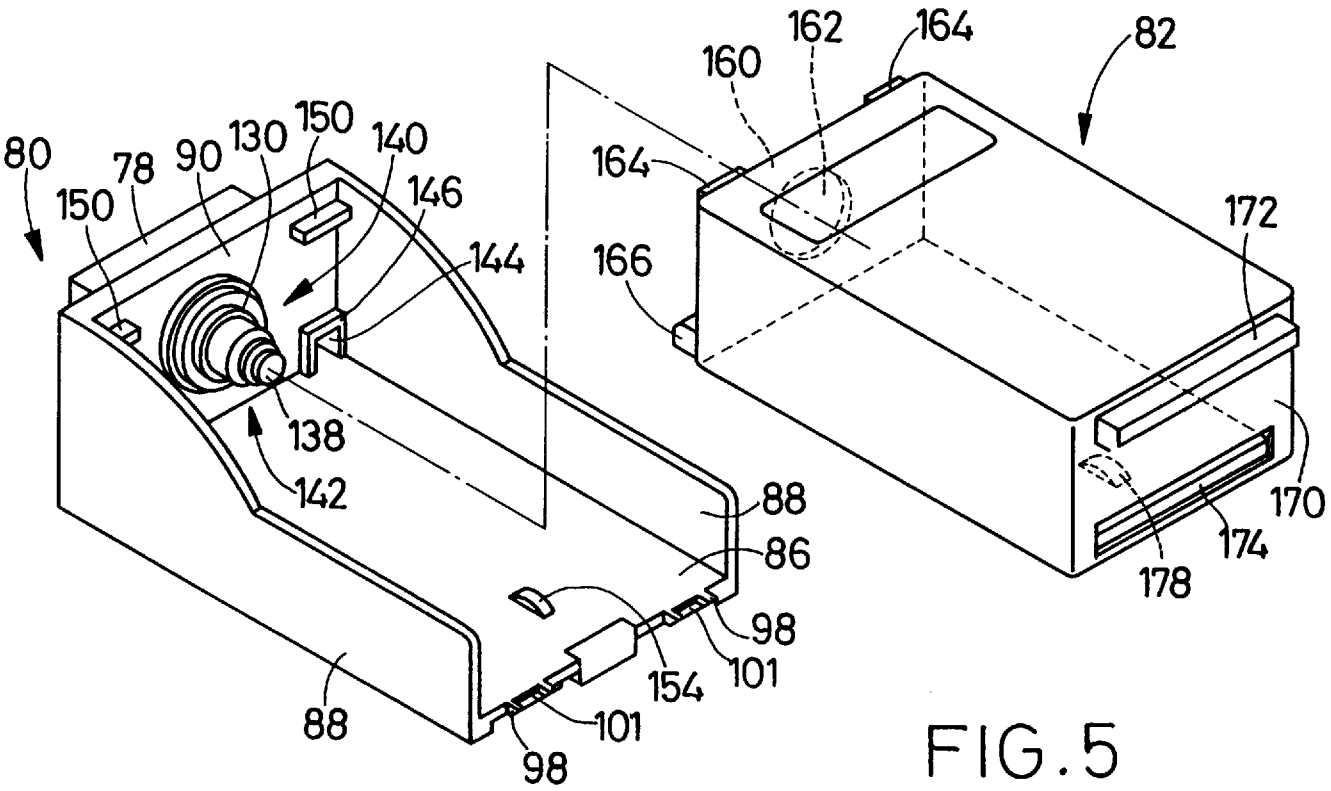
FIG. 5 is an exploded perspective view of an ink container and a head holder of the ink jetting apparatus of FIG. 1.

As shown in FIG. 2, the ink jetting apparatus 30 includes the ink jetting head 78, a head holder 80, and an ink container 82. The head holder 80 is detachably attached to the carriage 32. As shown in FIG. 5, the head holder 80 has a bottom wall 86, two side walls 88, and a front wall 90. The side walls 88 extend upward from opposite side edges of the bottom wall 86 which edges extend in the front-rear direction. The front wall 90 extend upward from a front edge of the bottom wall 86.

The front wall 90 of the head holder 80 has two engageable projections 94 (only one 94 is shown in FIG. 2) which are provided in a lower portion of a front surface 91 of the front wall 90 and project frontward. The two projections 94 are remote from each other in the direction of width of the head holder 80, i.e., in the movement direction of the carriage 32. Each of the projections 94 has an inclined lower surface 96 which is inclined frontward and upward. As shown in FIG. 5, the bottom wall 86 of the head holder 80 has two engageable projections 98 which are provided in a rear surface of the bottom wall 86 and project rearward. The two projections 98 are remote from each other in the direction of width of the head holder 80. As shown in FIG. 2, each of the projections 98 has an inclined lower surface 100 which is inclined frontward and downward, and an engageable recess 101 which opens upward and rearward.

When a user attaches the head holder 80 to the carriage 32, first, he or she holds, in his or her hand, the head holder 80 to take an inclined position in which a front portion of the head holder 80 is lower than a rear portion thereof. Subsequently, the front engageable projections 94 of the head holder 80 are fitted in, and engaged with, the engageable holes 54 formed in the front wall 36 of the carriage 32. Then, the head holder 80 is rotated relative to the carriage 32 about the engaged projections and holes 94, 54, in a direction in which the rear portion of the head holder 80 approaches the bottom wall 34 of the carriage 32. During this rotation of the head holder 80, the front projections 94 are moved forward within the holes 54 and the lower inclined surfaces 100 of the rear engageable projections 98 are engaged with the upper inclined surfaces 68 of the engageable projections 70 of the head-holder hooks 64 of the carriage 32. Because of this engagement of the inclined surfaces 100, 68, the front arms 66 of the hooks 64 are elastically deformed rearward so that the rear projections 98 are moved over the projections 70 of the hooks 64. Thus, the head holder 80 is attached to the carriage 32. Since the front projections 94 have the inclined lower surfaces 96 and have respective widths which decrease into respective free ends thereof, the projections 94 are easily fitable in the holes 54 without having to provide so great dimensions of the holes 54 in a vertical direction. In the state in which the head holder 80 is attached to, and supported by, the carriage 32, respective upper surfaces of the front projections 94 are held in contact with respective inner, upper surfaces of the holes 54.

When the rear projections 98 of the head holder 80 are moved over the front projections 70 of the head-holder hooks 64, the rear recesses 101 of the head holder 80 are engaged with the front projections 70. Thus, the head holder 80 is effectively prevented from moving up and down or "bouncing" on the carriage 32, because of the engagement of the upper surfaces of the front projections 94 of the head holder 80 with the opposed inner surfaces of the holes 54 of the carriage 32 and the engagement of bottom surfaces of the recesses 101 with the front projections 70 of the head-holder hooks 64. In addition, the head holder 80 is effectively prevented from moving relative to the carriage 32 in the direction of movement of the head holder 80 (i.e., direction of the movement of the carriage 32), because of engagement of opposite side surfaces of each of the front projections 94 with opposed inner, side surfaces of a corresponding one of the holes 54 and the engagement of the recesses 101 with the projections 70. The opposite side surfaces of each projection 94 extend parallel to the front-rear direction. The head holder 80 is biased frontward by the head-holder hooks 64 against the front wall 36 of the carriage 32 so that the head holder 80 is accurately positioned in the front-rear direction.

The head holder 80 can be detached from the carriage 32 by first elastically deform the front arms 66 of the head-holder hooks 64 rearward to disengage the rear projections 98 of the head holder 80 from the front projections 70 of the hooks 64 and then rotating the head holder 80 in a direction in which the rear portion of the holder 80 is moved away from the bottom wall 34 of the carriage 32 while simultaneously disengaging the front projections 94 from the holes 54.

The ink jetting head 78 is supported by the front wall 90 of the head holder 80. The ink jetting head 78 has a generally rectangular shape, and has a number of ink passages (not shown) and a number of ink jetting nozzles (not shown) corresponding to the ink passages, respectively. The ink jetting nozzles open in the ink jetting surface (not shown) as a front surface of the ink jetting head 78, and are arranged in an array along a straight line. As shown in FIG. 2, a head support projection 106 which has a head support recess 108 opening in a free end of the projection 106 extends from the front surface 91 of the front wall 90 of the head holder 80. The ink jetting head 78 is fitted in the recess 108 such that the straight line along which the array of ink jetting nozzles extend is inclined with respect to the movement direction of the head holder 80.

Each ink passage has a wall provided by a diaphragm which is deformable by a drive circuit (not shown) under commands of a control device (not shown). When the diaphragm is deformed and the pressure is changed, the ink is jetted out from a nozzle corresponding to the ink passage. As shown in FIG. 2, the ink jetting head 78 is provided with a flexible printed circuit (FPC) substrate 112. The FPC substrate 112 is held by a rubber-based holder member 114 which is secured to the lower surface of the bottom wall 86 of the head holder 80. When the head holder 80 is attached to the carriage 32, the FPC substrate 112 is pressed against a circuit substrate (not shown) provided on the upper surface of the bottom wall 34 of the carriage 32. An FPC hold-down member 116 is provided around the ink jetting head 78 so as to cover and protect the FPC substrate 112.

As shown in FIG. 3, a cylindrical manifold 120 having a circular cross section projects rearward from a middle portion of a rear surface 92 of the front wall 90 of the head holder 80. The manifold 120 has an ink flow passage 122 which is formed therethrough, extends parallel to an axis line of the manifold 120, and opens in an end surface of the manifold 120. The ink flow passage 122 includes a tapered portion 124 which opens in the end surface of the manifold 120 and whose diameter increases near the opening. The end surface of the manifold 120 in which the ink passage 122 opens is covered by a mesh filter 126 which is obtained by braiding, e.g., a stainless-steel fibers. The mesh filter 126 has fine holes which permits the ink to pass therethrough and whose diameter is about 8 microns. The mesh filter 126 is adhered to the end surface of the manifold 120.

A rubber-based cylindrical support member 130 is externally fitted on the manifold 120 such that the support member 130 is detachable from the manifold, 120. When the support member 130 is fitted on the manifold 120, a rear end portion 132 of the support member 130 extends rearward over the end surface of the manifold 120. The end portion 132 of the support member 130 is tapered such that an outer diameter thereof gradually decreases near an end surface thereof. Thus, the cylindrical support member 130 includes the tapered end portion 132. However, the cylindrical support member 130 with the tapered end portion 132 may be replaced by a tapered support member which is tapered over an entire length thereof and whose diameter gradually decreases into an end surface thereof. The support member 130 has a flange portion 134 which extends radially outward from a base end portion thereof, and a flared portion 136 which spreads rearward such that an inner dimension of the flared portion 136 increases in a direction away from the flange portion 134.

Figure 6:
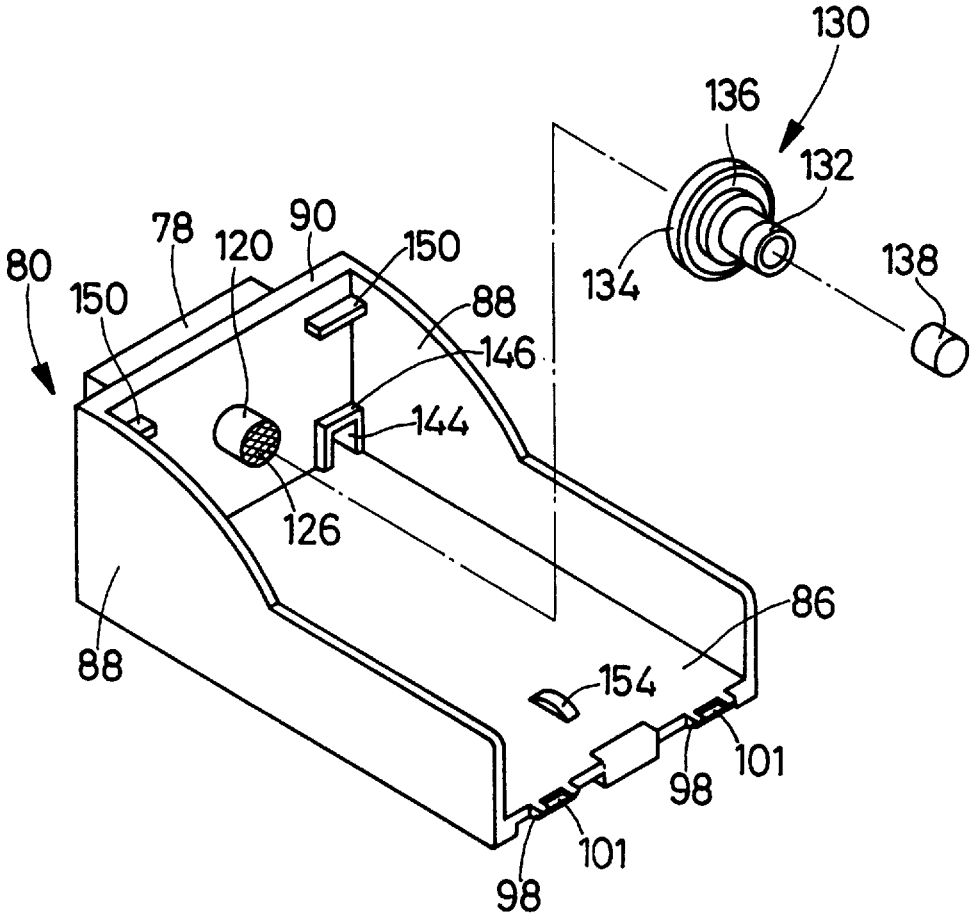
FIG. 6 is an exploded perspective view of a connecting device of the ink jetting apparatus of FIG. 1.

A cylindrical porous or coarse body 138 is fixedly fitted in the tapered end portion 132 of the support member 130 which projects rearward over the manifold 120. The porous body 138 is provided by, e.g., a felt or a bundle of fibers. The porosity of the porous body 138 is higher than that of the mesh filter 126. Specifically, the porous body 138 has fine passages which permit the ink to pass therethrough, and the fine passages have a greater dimension in a direction perpendicular to a direction of passing therethrough of the ink, than a dimension of the fine holes of the mesh filter 126 in a direction perpendicular to a direction of passing therethrough of the ink. One end of the porous body 138 projects outward or rearward from the support member 130 and the other end of the same 138 is held in contact with the mesh filter 126. If the support member 130 is detached from the manifold 120, the porous body 138 is also detached with the support member 130. However, the mesh filter 126 remains fixed to the manifold 120. The support member 130 and the porous body 139 provide an integral connecting member which is detachably attached to the manifold 120 and which cooperates with the manifold 120 and the mesh filter 126 to provide a connecting device 142 which connects between the ink jetting head 78 and an ink outlet 162 (described later) of the ink container 82. FIG. 6 is an exploded view of the mesh filter 126, the support member 130, and the porous body 138.

As shown in FIGS. 3 and 5, two engageable recesses 144 are formed in a lower portion of the front wall 90 of the head holder 80, such that the two recesses 144 are located on both sides of the manifold 120 and open in the rear surface 92 of the front wall 90 (only one 144 is shown in FIG. 3 or 5). A projection 146 projects rearward from a periphery of the opening of each recess 144. As shown in FIG. 2, an inner, lower surface 148 of each recess 144 is continuous with an upper surface 147 of the bottom wall 86 of the head holder 80. The inner lower surface 148 is inclined frontward and upward from the upper surface 147, i.e., climbs up near an inner, front (or bottom) surface of each recess 144. An inner, upper surface 149 of each recess 144 is horizontal.

The head holder 80 has two projection-receiving portions 150 which project rearward from an upper portion of the front wall 90 thereof, such that the two receiving portions 154 are located on both sides of the manifold 120. Each receiving portion 150 is elongate in the movement direction of the head holder 80.

A positioning-related engageable projection 154 having a part-cylindrical top surface is provided on the upper surface 147 of the bottom wall 86 of the head holder 80, such that the projection 154 or the part-cylindrical top surface thereof is elongate in the front-rear direction perpendicular to the movement direction of the head holder 80. The projection 154 is located at a middle position of the upper surface 147 in the movement direction of the head holder 80, and a distance between the front wall 90 and the projection 154 in the front-rear direction is greater than a dimension of the ink container 82 in the movement direction of the head holder 82.

Figure 7:
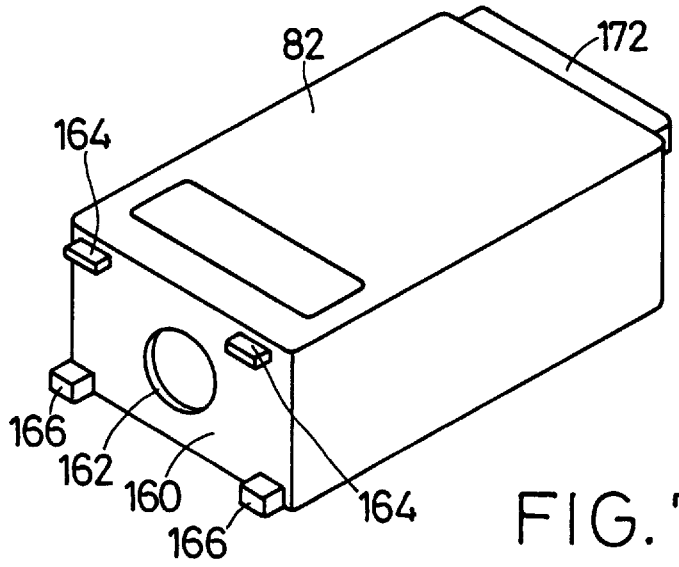
FIG. 7 is a perspective view of the ink container of FIG. 5.

As shown in FIG. 7, the ink container 82 has a box-like rectangular shape and has the circular ink outlet 162 which is formed through a middle portion of a front wall 160 of the ink container 82 and opens in a front surface 165 (FIG. 3) of the front wall 160. The ink container 82 accommodates an ink retainer member (not shown) which is formed of, e.g., urethane foam and in which ink is impregnated.

Figure 8:
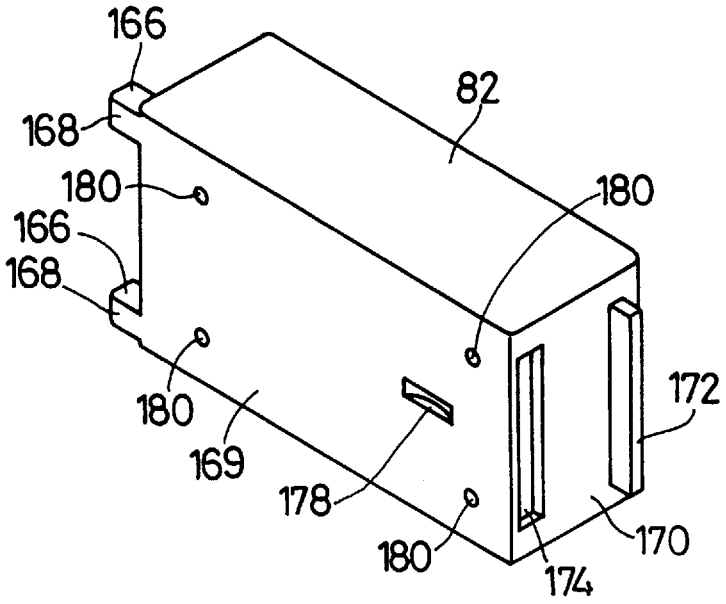
FIG. 8 is another perspective view of the ink container of FIG. 5.

As shown in FIG. 7, two upper engageable projections 164 project frontward from an upper end portion of the front surface 165 of the ink container 82, such that the two upper projections 164 are located on both sides of the ink outlet 162 in the movement direction of the head holder 80. Each upper projection 164 is elongate in the holder-movement direction. In addition, two lower engageable projections 166 project frontward from a lower end portion of the front surface 165 of the ink container 82, such that the two lower projections 166 are located on both sides of the ink outlet 162 in the movement direction of the head holder 80. As shown in FIGS. 3 and 8, each lower projection 166 has a lower surface 168 which is flush with a lower surface 169 of the ink container 82. An upper surface 171 of each lower projection 166 is parallel to the lower surface 168.

A plate-like rear projection 172 which is elongate in the holder-movement direction projects rearward from an upper portion of a rear surface of a rear wall 170 of the ink container 82. An engageable recess 177 is formed in a lower portion of the rear surface of the ink container 82. The ink container 82 has a positioning-related engageable recess 178 which has a part-cylindrical bottom surface and opens in the lower surface 169. The recess 178 is located at a middle position of the lower surface 169 in the holder-movement direction, and a distance between the ink outlet 162 and the recess 178 in the front-rear direction perpendicular to the holder-movement direction is greater than the dimension of the ink container 82 in the holder-movement direction. The recess 178 is formed with accurate dimensions which ensure that the position-related engageable projection 154 fits in, i.e., is engaged with, the recess 178 with substantially no clearances remaining in the holder-movement direction.

Four hemi-spherical projections 180 projects from the lower surface 169 of the ink container 82 such that two of the four projections 180 are remote from each other in the holder-movement direction and the other two projections 180 are remote from the first two projections 180 in the front-rear direction, respectively, as shown in FIG. 8. The projecting amount of the projections 180, i.e., radius of the same 180 is predetermined at a value which ensures that when the ink container 82 is placed on the bottom wall 86 of the head holder 80 and the projections 180 are supported by the upper surface 147 of the bottom wall 86, the respective upper surfaces 171 of the lower engageable projections 166 are flush with the respective upper surfaces 149 of the engageable recesses 144 of the front wall 90 of the head holder 80.

As shown in FIG. 2, a cover member 184 covers the casing 12. The cover member 184 is connected to the casing 12 such that the cover member 184 is rotatable about an axis line parallel to the holder-movement direction. The axis line of rotation of the cover member 184 is located on one side of the platen 10 which is opposite to the other side of the same 10 on which side the ink jetting apparatus 30 is located. When the cover member 184 is fully rotated by the user, the cover member 184 is opened above the ink jetting apparatus 30, so that the user can get access to the ink jetting apparatus 30 through the opened top of the casing 12.

Figure 9:
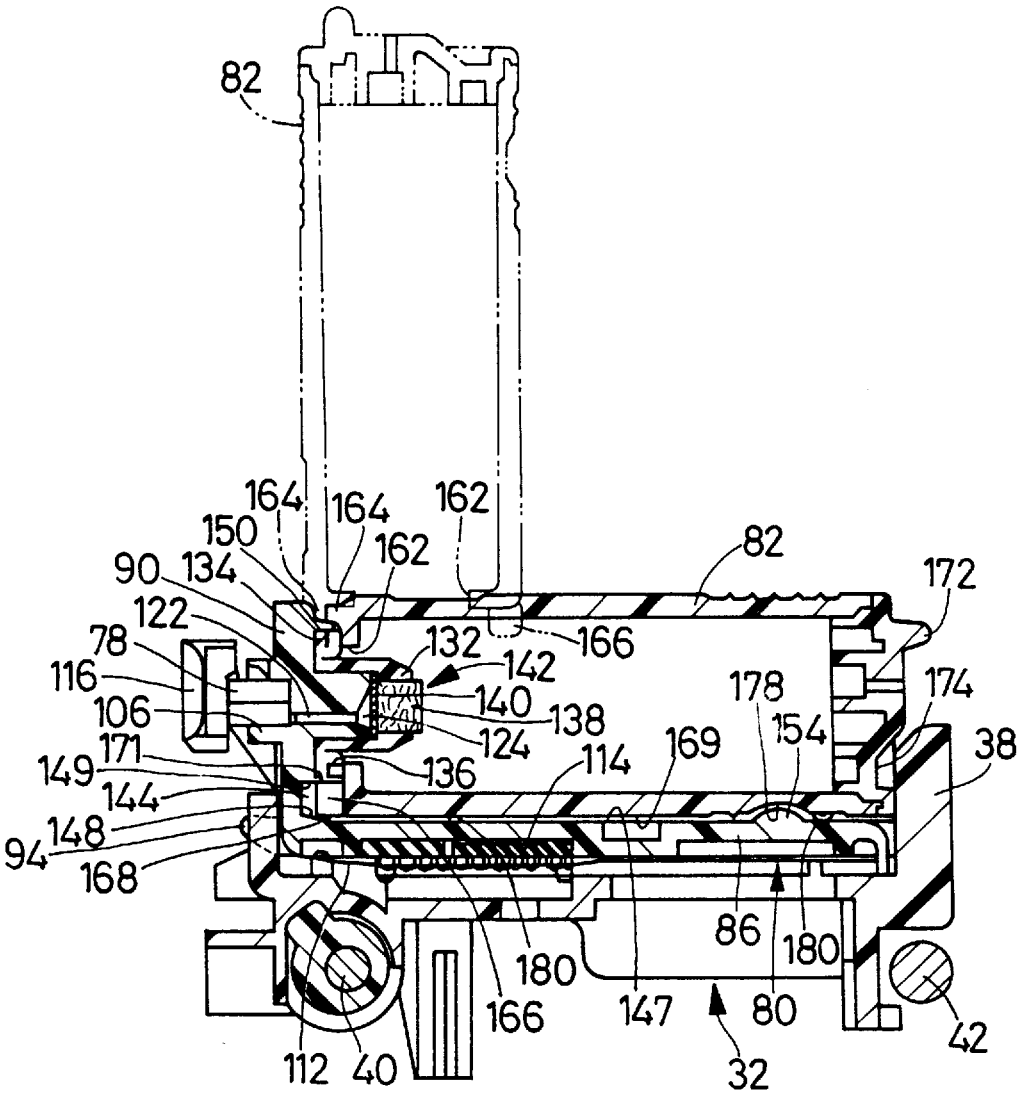
FIG. 9 is a view for illustrating the manner in which the ink container of FIG. 5 is attached to the head holder of FIG. 5.
Figure 10:
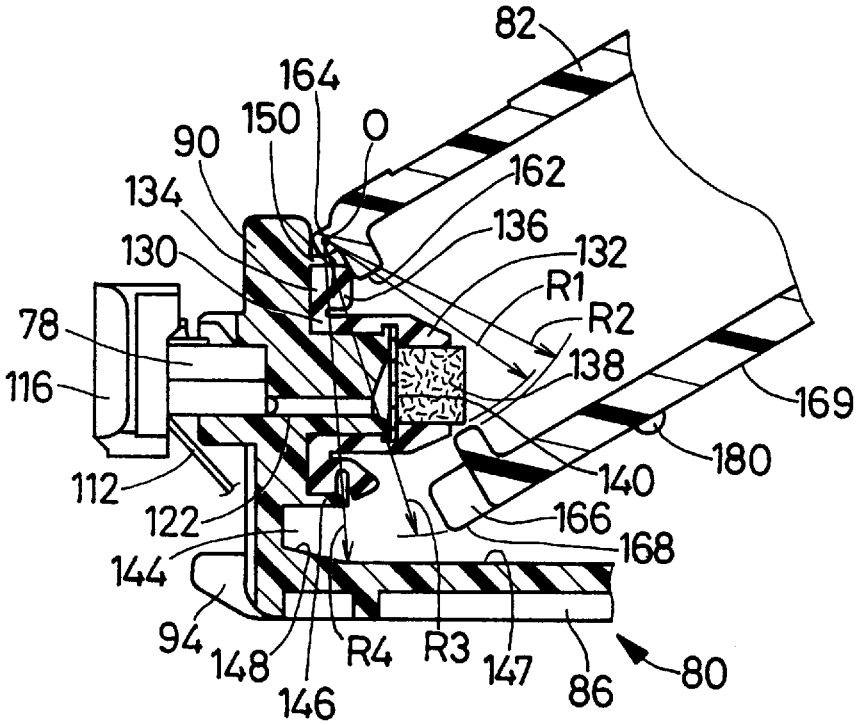
FIG. 10 is a view for illustrating the manner in which the positions of upper engageable projections of the ink container of FIG. 5 and the positions of engageable-projection receiving portions of the head holder of FIG. 5 are predetermined.

As indicated in two-dot chain line in FIG. 9, when the ink container 82 is attached to the head holder 80, the rear projection 172 of the ink container 82 is pinched by fingers of the user so that the ink container 82 takes a vertical position in which the front portion thereof is lower than the rear portion thereof and so that the front portion is fitted between the two side walls 88 of the head holder 80 and the upper engageable projections 164 are engaged with the projection receiving portions 150 of the front wall 90 of the head holder 80. When the ink container 82 is rotated about the engaged projections and receiving portions 164, 150, the connecting device 142 of the head holder 80 enters the ink outlet 162 of the ink container 82 without being interfered with by an ink-outlet defining portion of the front wall 160 of the ink container 82 which portion surrounds and defines the ink outlet 162, and the ink container 82 is brought into an operative position in which the ink container 82 is supported by the bottom wall 86 of the head holder 80. That is, the ink container 82 is rotated without any interference between the peripheral portion of the ink outlet 162 and the porous body 138 and/or the support member 130 of the connecting device 142. To this end, as shown in FIG. 10, a distance, R1, between a lowermost end of the porous body 138 and a rotation center, O, of the upper projections 164 engaged with the receiving portions 150, a distance, R2, between a lowermost end of the ink outlet 162 and the rotation center O, a distance, R3, between lowermost ends of the lower engageable projections 166 and the rotation center O, and a distance, R4, between the upper surface 147 of the bottom wall 86 of the head holder 80 and the rotation center O are so predetermined as to satisfy the following expression: R1<R2<R3<R4.

Accordingly, when the ink container 82 is rotated from the vertical position thereof indicated in two-dot chain line in FIG. 9, the porous body 138 and the tapered portion 132 of the cylindrical support member 130 can enter the ink outlet 162 without being interfered with by the edge portion of the ink outlet 162. When the ink container 82 is rotated to a position near the above-indicated operative position thereof, the lower projections 166 contact the inner inclined surfaces 148 of the engageable recesses 144, and the upper projections 164 naturally disengage from the receiving portions 150. Thereafter, the lower projections 166 are guided by the inner inclined surfaces 148 and, as the lower surface 169 of the ink container 82 approaches the bottom wall 86 of the head holder 80, the lower projections 166 slightly climb up because of the inclination of the inner inclined surfaces 148. Thus, the positioning-related engageable recess 178 of the ink container 82 is engaged with the positioning-related engageable projection 154 of the head holder 80. Finally, the support projections 180 of the ink container 82 are supported by the upper surface 147 of the bottom wall 86 of the head holder 82, and the upper surfaces 171 of the lower projections 166 are held in contact with the inner upper surfaces of the engageable recesses 144 of the front wall 90 of the head holder 80.

The reasons why the lower projections 166 of the ink container 82 do not contact the head holder 80 before a final phase of rotation of the ink container 82, are as follows:

In the case where the ink container 82 is attached to the head holder 80 by being rotated about the upper projections 164 thereof being engaged with the receiving portions 150, it is possible that the lower projections 166 of the ink container 82 be not supported by the head holder 80. In the latter case, the upper projections 164 continue to engage the receiving portions 150 till the end of rotation of the ink container 82 relative to the head holder 80.

Since in the present embodiment the upper projections 164 project from the upper end portion of the ink container 82 which portion is more remote from the bottom wall 86 of the head holder 80 than the lower end portion of the same 82, the ink outlet 162 of the ink container 82 approaches the bottom wall 86 as the ink container 82 is rotated relative to the head holder 80. In this step, since an upper edge portion of the ink outlet 162 which is remote from the bottom wall 86 monotonously approaches from a position remote from the connecting device 142 toward the same 142, there is no chance that the upper edge portion of the ink outlet 162 can collide with the connecting device 142. However, a lower edge portion of the ink outlet 162 which is near to the bottom wall 86 moves from a position opposite to the bottom wall 86 with respect to the connecting device 142, to a position on the side of the bottom wall 86, over the porous body 138 of the connecting device 142, there is some chance that the lower edge portion of the ink outlet 162 can collide with the connecting device 142. This interference may effectively be avoided by providing the engageable projections 164 and the receiving portions 150 at respective positions much nearer to the bottom wall 86. In the last case, however, there arise some chances that the upper edge portion of the ink outlet 162 can collide with the connecting device 142.

The present embodiment is free from the above problem. That is, in the present embodiment, almost all the rotation of the ink container 82 relative to the head holder 80 is effected by rotating the ink container 82 about the upper projections 164 engaged with the receiving portions 150, and only the final phase of the rotation is obtained by rotating the ink container 82 about the lower projections 166 being supported by the head holder 80. Stated differently, as the ink container 82 is rotated relative to the head holder 80, the ink outlet 162 almost monotonously approaches the bottom wall 86. However, in the final phase of the rotation, the rate of approaching of the ink outlet 162 relative to the bottom wall 86 decreases. Alternatively, in the final phase, the ink outlet 162 may positively be moved away from the bottom wall 86.

In addition, the engageable recesses 144 which are engageable with the lower projections 166 have the inner inclined surfaces 148 which are continuous with the upper surface 147 of the bottom wall 86 of the head holder 80 and which are so inclined as to climb up in a vertical direction. Moreover, the lower projections 166 have a generally rectangular shape with a constant dimension in a vertical direction that is perpendicular to the direction of width of the head holder 80 and the ink jetting direction. Therefore, as the lower projections 166 are deeply fitted into the recesses 144, distances or clearances between the upper surfaces 171 of the projections 166 and the inner upper surfaces 149 of the recesses 144 in the vertical direction decrease. Thus, when the lower projections 166 are fully engaged with the recesses 144, there remain only small clearances, or even no clearances, between the upper surfaces 171 of the projections 166 and the inner upper surfaces 149 of the recesses 144 in the vertical direction. Accordingly, while the ink container 82 is attached to the head holder 80, the ink container 82 is effectively prevented from moving up or "bouncing" on the head holder 80.

In the case where the lower projections 166 are engaged with the recesses 144 while the ink container 82 is rotated relative to the head holder 80, some clearances are needed between the upper surfaces 171 of the projections 166 and the inner upper surfaces 149 of the recesses 144 in the vertical direction, because the projections 166 are inclined with respect to the recesses 144 during an initial and an intermediate phase of the rotation. If unnecessarily large clearances were provided between the upper surfaces 171 of the projections 166 and the inner upper surfaces 149 of the recesses 144 in the vertical direction, the ink container 82 could not be prevented from moving up or bouncing on the head holder 80. The present embodiment is, however, free from this problem.

When the ink container 82 is rotated, a lower end portion of the rear wall 170 of the ink container 82 is engaged with the top inclined surface 60 of the ink-container hook 56. As a result, the front arm 58 of the hook 56 is elastically deformed rearward, so that the lower end portion of the rear wall 170 moves over the front projection 62. In the state shown in FIG. 3 in which the ink container 82 is set on the bottom wall 86 of the head holder 80, the front projection 62 of the ink-container hook 56 is engaged with the rear recess 174 of the ink container 82, so that the arm 58 of the hook 56 prevents the ink container 82 from bouncing on the bottom wall 86.

While the ink container 82 is rotated and attached to the head holder 80, the ink container 82 is sandwiched by the two side walls 88 of the head holder 80, so that the ink container 82 is securely positioned in the holder-movement direction parallel to the axis line of rotation of the ink container 82 relative to the head holder 80. Thus, the ink container 82 can be rotated with stability relative to the head holder 80. That is, the position of the ink outlet 162 relative to the position of the connecting device 142 in the direction of width of the ink container 82 does not change. In addition, the lower projections 166 are easily and securely fitted in the engageable recesses 144. Thus, the ink container 82 is easily attached to the head holder 80.

In the state in which the ink container 82 is supported by the head holder 80, the porous body 138 and the support member 130 of the connecting device 142 project into the ink outlet 162 of the ink container 82, so the the ink is impregnated into the porous body 138 and is supplied to the ink passages of the ink jetting head 78 via the ink flow passage 122 of the support member 130. The flared portion 136 of the support member 130 is elastically deformed to fluid-tightly contact an annular portion of the front surface 165 of the ink container 82 which surrounds the ink outlet 162, so as to prevent the leakage of the ink from the ink container 82 onto the head holder 80. Thus, the front wall 160 of the ink container 82 is held in contact with the flared portion 132 and the rear wall 170 of the same 82 is held in contact with a front surface of the rear wall 38 of the carriage 32, so that the ink container 82 is positioned in the front-rear direction. Since the ink container 82 is biased rearward by the flared portion 132 being elastically deformed, the ink container 82 is securely held in position in the front-rear direction.

In the state in which the ink container 82 is set on the head holder 80, the support projections 180 of the ink container 82 are supported by the bottom wall 86 of the head holder 80, so that the upper projections 164 are slightly separate from the receiving portions 150. Meanwhile, the upper surfaces 171 of the lower projections 166 are held in contact with the inner upper surfaces of the engageable recesses 144 and the rear recess 174 is held in engagement with the ink-container hook 56, so that the ink container 82 is prevented from bouncing on the bottom wall 86 of the head holder 80. Moreover, the positioning-related engageable projection and recess 154, 178 are engaged with each other and the two side surfaces of each of the lower projections 166 which surfaces extend in the front-rear direction are engaged with the opposed side surfaces of a corresponding one of the engageable recesses 144, so that the ink container 82 is prevented from moving in the holder-movement direction. Since the rear projections 146 project from around the openings of the recesses 144 in the rear surface 92 of the front wall 90, the lower projections 166 can be engaged with the recesses 144 over a great length in the front-rear direction. Thus, the projections 166 are easily engaged with the recesses 144. Since the ink container 82 is biased against the rear wall 38 of the carriage 32 by the flared portion 132 being elastically deformed, the ink container 82 is prevented from moving out of position in the front-rear direction. In this state, the ink outlet 162 is coaxial with the connecting device 142, and there remains a clearance in a vertical direction between the positioning-related projection and recess 154, 178 being engaged with each other.

When the ink container 82 is detached from the head holder 80, first, the user opens the cover member 184 and then rotates the ink container 82 in a direction in which the rear portion of the ink container 82 is moved away from the bottom wall 86 of the head holder 80. When the ink container 82 is rotated, the rear end portion of the ink container 82 is engaged with the bottom inclined surface 63 of the front projection 62 of the ink-container hook 56, so that the hook 56 is elastically deformed rearward because of the inclination of the bottom surface 63. Thus, the user can detach the ink container 82 from the head holder 80. After the rear end portion of the ink container 82 is moved over the ink-container hook 56, the ink container 82 is further rotated so that the ink outlet 162 is moved away from the porous body. 138 and the support member 130.

If the head holder 80 is left with no ink container 82 being attached thereto, some ink left in the porous body 138 dries up. However, the ink left on the mesh filter 126 is effectively prevented from drying up because the mesh filter 126 is covered by the porous body 138. If the support member 130 is left with no porous body 138 being attached thereto, the mesh filter 126 dries up, i.e., the ink left thereon becomes hard, so that the hard ink stops the ink flow. In the latter case, not only the mesh filter 126 but the ink jetting head 78 as a whole including the mesh filter 126 must be replaced with a new one. This costs high. In contrast, in the present embodiment, the head holder 80 may be left with no ink container 80 being attached thereto. If the porous body 138 which may be left in the support member 130 dries up, i.e., the ink impregnated in the porous body 138 dries up, the support member 130 including the porous body 138 may be removed from the manifold 120 and be changed with a new support member 130 including a new porous body 138. Changing the support members 130 costs much lower than changing the ink jetting heads 78.

As described previously, when the ink jetting apparatus 30 is moved within the recording area along the platen 10 to record images on the sheet 28, the head holder 80 is effectively prevented from moving relative to the carriage 32 in the holder-movement direction and the front-rear direction and from bouncing on the carriage 32, and the ink container 82 is effectively prevented from moving relative to the head holder 82 in the holder-movement direction and the front-rear direction and from bouncing on the head holder 82. The head holder 80 or the ink jetting head 78 is free from positional errors relative to the sheet 28 retained on the platen 10, so that the ink jetting apparatus 30 can record images at accurate positions on the sheet 28. In addition, the ink container 82 is free from positional errors relative to the head holder 80, so that no ink leaks from the ink container 82. Thus, accurate and clear images are recorded-on the sheet 28.

When the movement of the ink jetting apparatus 30 along the platen 10 is started or stopped, the ink container 82 is prevented from moving relative to the head holder 80, so that the speed of movement of the carriage 32 can be controlled with accuracy, without being adversely influenced by possible movements of the ink container 82 relative to the head holder 80.

As described previously, the ink container 82 is attached to the head holder 80 by being rotated from an initial inclined position thereof relative to the head holder 80, about the upper projections 164 being engaged with the receiving portions 150. An angle of inclination of the initial inclined position of the ink container 82 in which the upper projections 164 are initially engaged with the receiving portions 150 is freely selectable within a considerably wide angle range in which the projections 164 can be engaged with the receiving portions 150. Thus, the present ink jetting apparatus 30 enjoys a high degree of freedom of the direction in which the ink container 82 is attached to the head holder 80, and a high degree of freedom of the position at which the cover member 184 is produced.

Since the ink container 82 is inclined relative to the head holder 80 when the rotation of the ink container 82 is started, neither the rear wall 38 of the carriage 32 which is opposite to the front wall 90 of the head holder 80 which wall supports the connecting device 142, nor the ink-container hook 56 which functions as a clamping device for clamping the ink container 82 to the head holder 80 and which extends upward from the rear end of the carriage 32, interferes with the rotation of the ink container 82, because the ink container 82 is rotated relative to the head holder 80 about the upper projections 164 being engaged with the receiving portions 150. On the other hand, in the case where the ink container 82 is attached to the head holder 80 while taking a horizontal position in which a center line of the ink outlet 162 is substantially aligned with the axis line of the connecting device 142, such a clamping device is needed which is movable between an operative position in which the clamping device clamps the ink container 82 and a retracted position which is away from the operative position and in which the clamping device does not interfere with the attachment of the ink container 82 to the head holder 80. In the latter case, however, the construction of the clamping device is complicated. In the present embodiment, since the ink container 82 is attached to the head holder 80 while taking an inclined position, the clamping device 56 which is located opposite to the connecting device 142 of the head holder 80 does not interfere with the attachment of the ink container 82. Thus, the clamping device 56, i.e., the ink-container hook 56 enjoys a simple construction.

When the ink container 82 is rotated and engaged with the ink-container hook 56, the hook 56 is elastically deformed rearward, so that the ink container 82 is permitted to reach the bottom wall 86 of the head holder 80. The instant that the ink container 82 reaches the bottom wall 86 of the head holder 80, the hook 56 clamps the ink container 82 to the head holder 80 or the carriage 32. Thus, the ink container 82 is easily attached to the head holder 80.

Since the upper projections 164 are provided on the front surface 165 of the front wall 160 of the ink container 82, the ink container 82 can have a small width in the holder-movement direction. Thus, the overall size of the ink jetting apparatus 30 can be reduced.

The upper projections 164 are provided on the front surface 165 of the front wall 160 of the ink container 82 which wall is connectable to the connecting device 142 of the head holder 80, and project frontward from the upper end portion of the front wall 160 which portion is remote from the bottom wall 86 of the head holder 80. While the upper projections 164 are engaged with the receiving portions 150, the front wall 160 of the ink container 82 is entirely kept away from the front wall 90 of the head holder 80 which wall supports the connecting device 142, so that the connecting device 142 does not interfere with the rotation of the ink container 82 relative to the head holder 80. In this respect, too, the ink container 82 is easily attached to the head holder 80.

The ink container 82 is attached to the head holder 80 by being rotated about the two upper projections 164 thereof which are remote from each other in the direction of width of the ink container 82. In this state, the two projections 164 are engaged with the two receiving portions 150 of the head holder 80, respectively. Therefore, the ink container 82 are rotated while being kept parallel to the direction of width of the head holder 80. Thus, the ink container 82 can be attached to, and detached from, the head holder 80 while taking a stable position.

The lower surfaces 168 of the lower projections 166 are flush with the lower surface 169 of the ink container 82. The lower projections 166 do not project downward over the lower surface 169 of the ink container 82, and are located adjacent to the lower surface 169. Thus, the lower projections 166 may have a sufficiently great length which ensures that the projections 166 are securely engaged with the engageable recesses 144.

Midway during the rotation of the ink container 82, the lower projections 166 contact the upper surface 147 of the bottom wall 86 of the head holder 80. This arrangement leads to preventing possible interferences of the connecting device 142 with both the upper and lower edge portions of the ink outlet 162 which are remote from, and near to, the bottom wall 86 of the head holder 80, respectively. As described above, in the present embodiment, the lower projections 166 project frontward from the lower end portion of the front wall 160 of the ink container 82 which portion is the nearest to the bottom wall 86 of the head holder 80, and the lower surfaces 168 of the projections 166 are flush with the lower surface 169 of the ink container 82. The lower projections 169 have a considerably great length to effectively prevent the possible interferences of the connecting device 142 with the peripheral portion of the ink outlet 162. Thus, the lower projections 166 can securely be engaged with the engageable recesses 144. The upper surface 147 of the bottom wall 86 of the head holder 80 functions as a support or guide surface which supports or guides the lower projections 166 functioning as support or guide members.

Since the two lower projections 166 are engaged with the two engageable recesses 144, respectively, the possible interference between the peripheral portion of the ink outlet 162 and the connecting device 142 can be avoided with higher reliability.

In the first embodiment, the ink container 82 is prevented from moving out of position relative to the head holder 80 in the holder-movement direction, because of the engagement of the positioning-related engageable recess 178 provided in the lower surface 169 of the ink container 82 and the positioning-related engageable projection 154 provided in the upper surface 147 of the bottom wall 86 of the head holder 80. However, this positioning of the ink container 82 may be achieved in a different manner.

Figure 11:
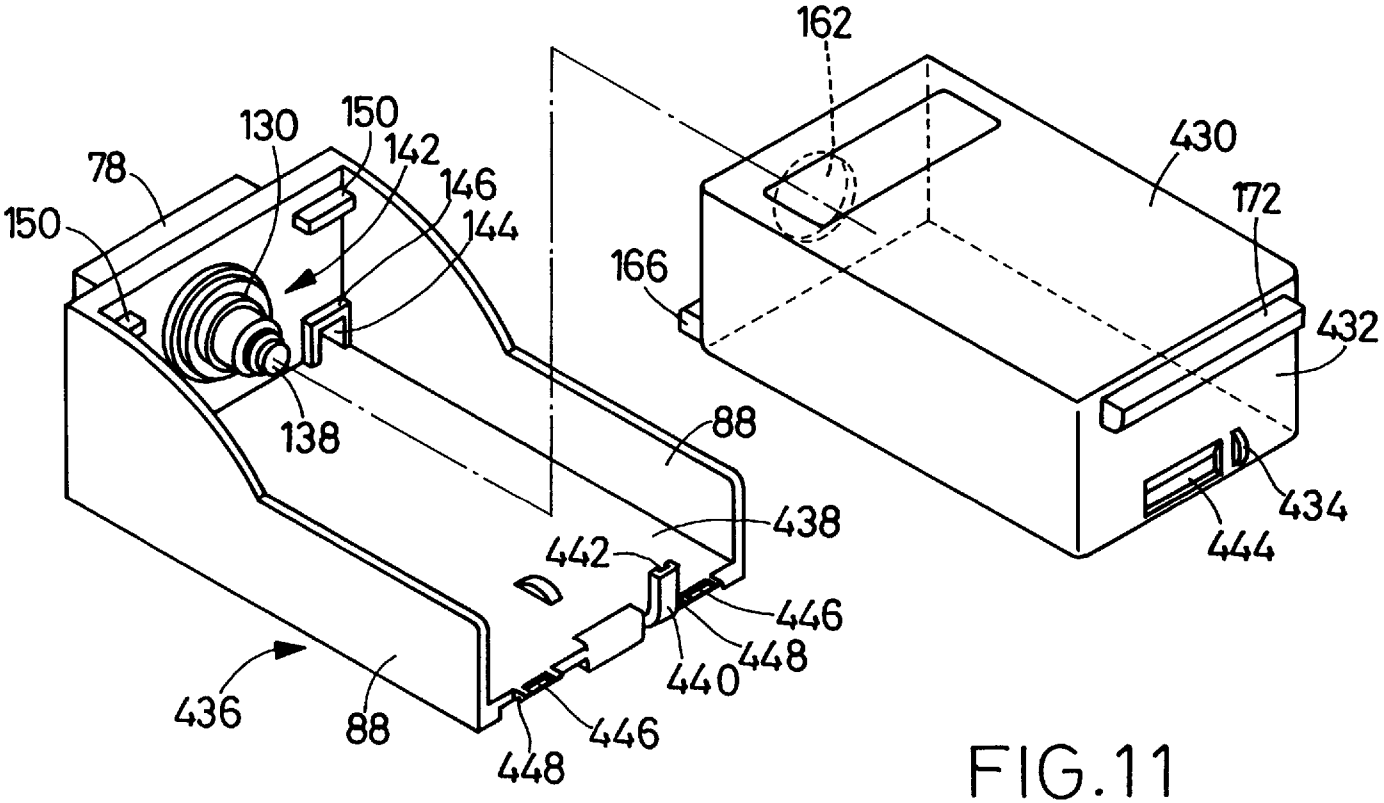
FIG. 11 is a perspective view corresponding to FIG. 5, showing an ink container and a head holder of another ink-jet printer including an ink jetting apparatus and a cartridge for use therewith to which the present invention is applied.
Figure 12:
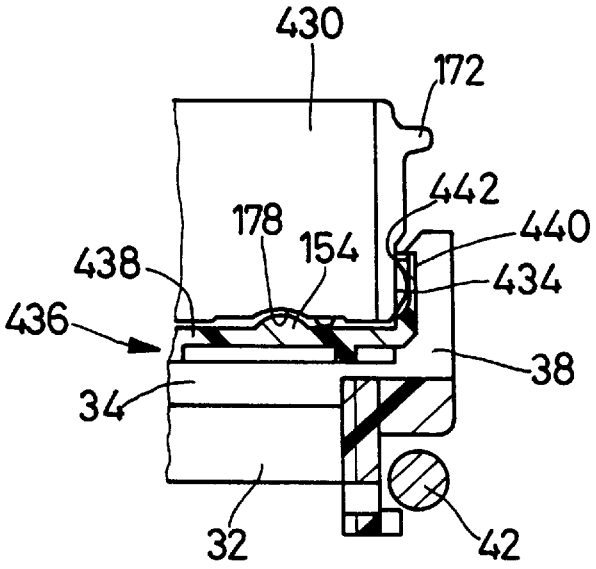
FIG. 12 is a cross-sectional elevation view of the ink container of FIG. 11, showing a state in which the ink container is positioned relative to the head holder in a direction of movement of the head holder by the engagement of a positioning-related engageable projection of the ink container and a positioning-related engageable recess of the head holder of FIG. 11.

FIGS. 11 and 12 shows a second embodiment of the present invention in which an ink container 430 is prevented from moving out of position relative to a head holder 436 in a holder-movement direction because of engagement of a positioning-related engageable projection 434 provided on a rear surface of a rear wall 432 of the ink container 430 and a positioning-related engageable recess 442 provided in an engageable rear wall 440 extending upward from a rear end of a bottom wall 438 of the head holder 436. The projection 434 has a part-cylindrical rear surface. The recess 442 extends in a vertical direction and opens in a front and a top surface of the rear wall 440.

An engageable rear recess 444 is formed in a lower and intermediate portion of the rear surface of the rear wall 432 of the ink container 430. The rear recess 444 is engageable with an ink-container hook 56 of the carriage 32. The projection 434 extends in a vertical direction, at a position adjacent to the recess 444. Two engageable rear projections 448 project rearward from the rear end of the bottom wall 438 of the head holder 436. The two rear projections 448 have respective engageable recesses 446 which are engageable with two head-holder hooks 64 of the carriage 32, respectively. The engageable rear wall 440 extends upward at a position adjacent to one of the two rear projections 448. Thus, the positioning-related projection and recess 434, 442 are located at the respective positions which ensure that the projection and recess 434, 442 do not interfere with the clamping of the head holder 436 to a carriage 32 by the head-holder hooks 64 and the clamping of the ink container 430 to the head holder 436 by the ink-container hook 56.

As shown in FIG. 12, when the ink container 430 is rotated and attached to the head holder 436, the positioning-related projection 434 is engaged with the positioning-related recess 442, and the engageable recess 444 is engaged with the ink-container hook 56. Thus, the ink container 430 is prevented from being dislocated relative to the head holder 436 both in a front-rear direction and the holder-movement direction, or bouncing on the head holder 436 in a vertical direction.

Except the above-described structural and functional features, the second embodiment shown in FIGS. 11 and 12 is the same as the first embodiment shown in FIGS. 1–10.

In the first or second embodiment, the ink container 82, 430 has the two upper projections 164 which project frontward from the front surface 165 of the front wall 160 thereof and which are engageable with the receiving portions 150 of the front wall 90 of the head holder 80, 436. The ink container 82, 430 is rotated relative to the head holder 80, 436, about the upper projections 164 being engaged with the receiving portions 150. However, the ink container 82, 430 may be rotated relative to the head holder 80, 436 in a different manner.

Figure 13:
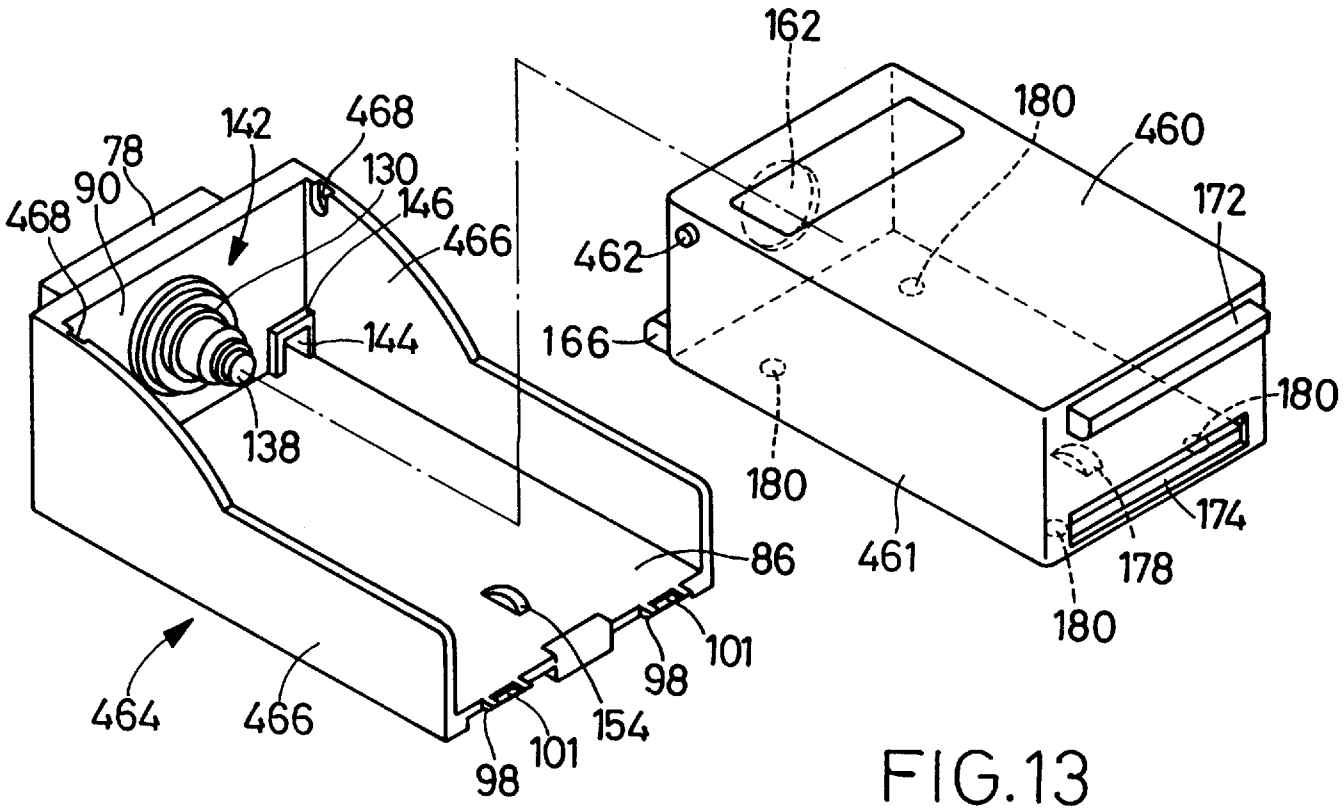
FIG. 13 is a perspective view corresponding to FIG. 5, showing an ink container and a head holder of another embodiment of the present invention.
Figure 14:
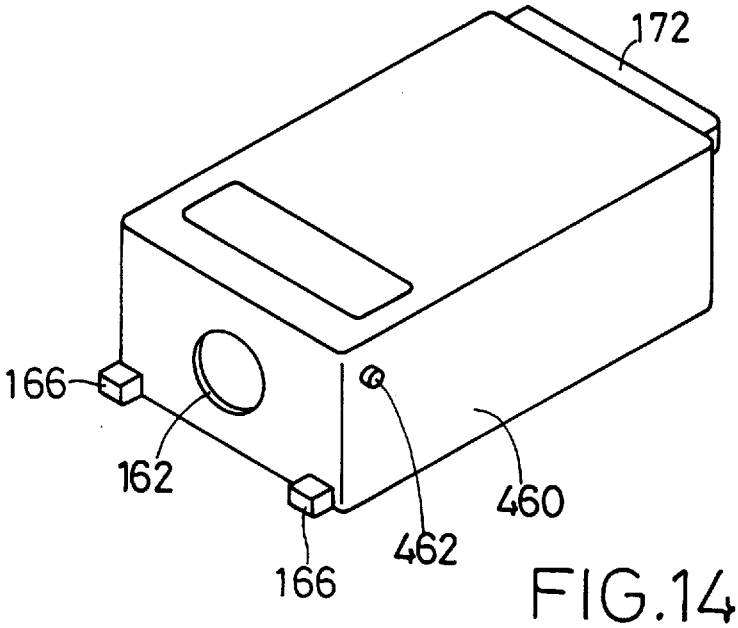
FIG. 14 is a perspective view of the ink container of FIG. 13.
Figure 15:
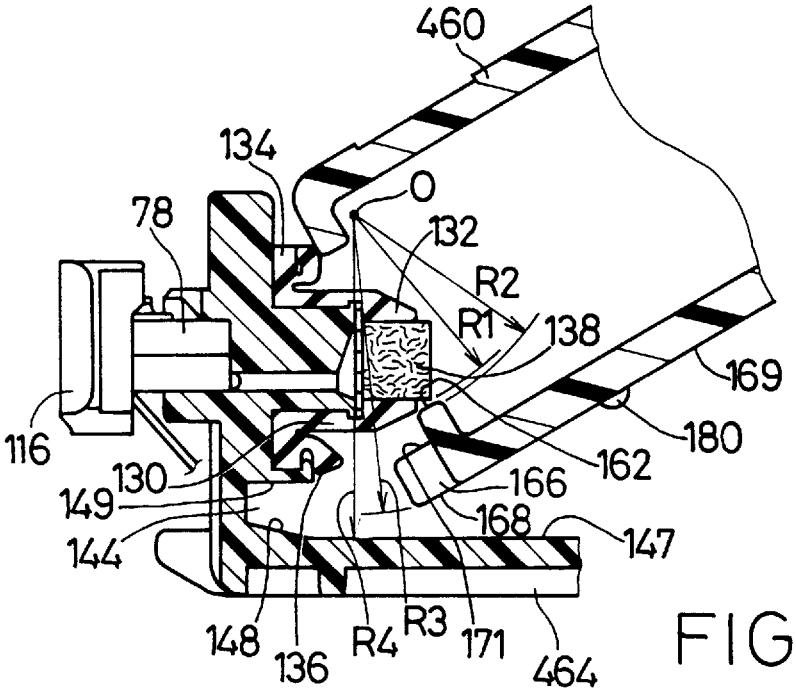
FIG. 15 is a view corresponding to FIG. 10, for illustrating the manner in which the positions of axle portions of the ink container of FIG. 13 and the positions of bearing portions of the head holder of FIG. 13 are predetermined.
Figure 16:
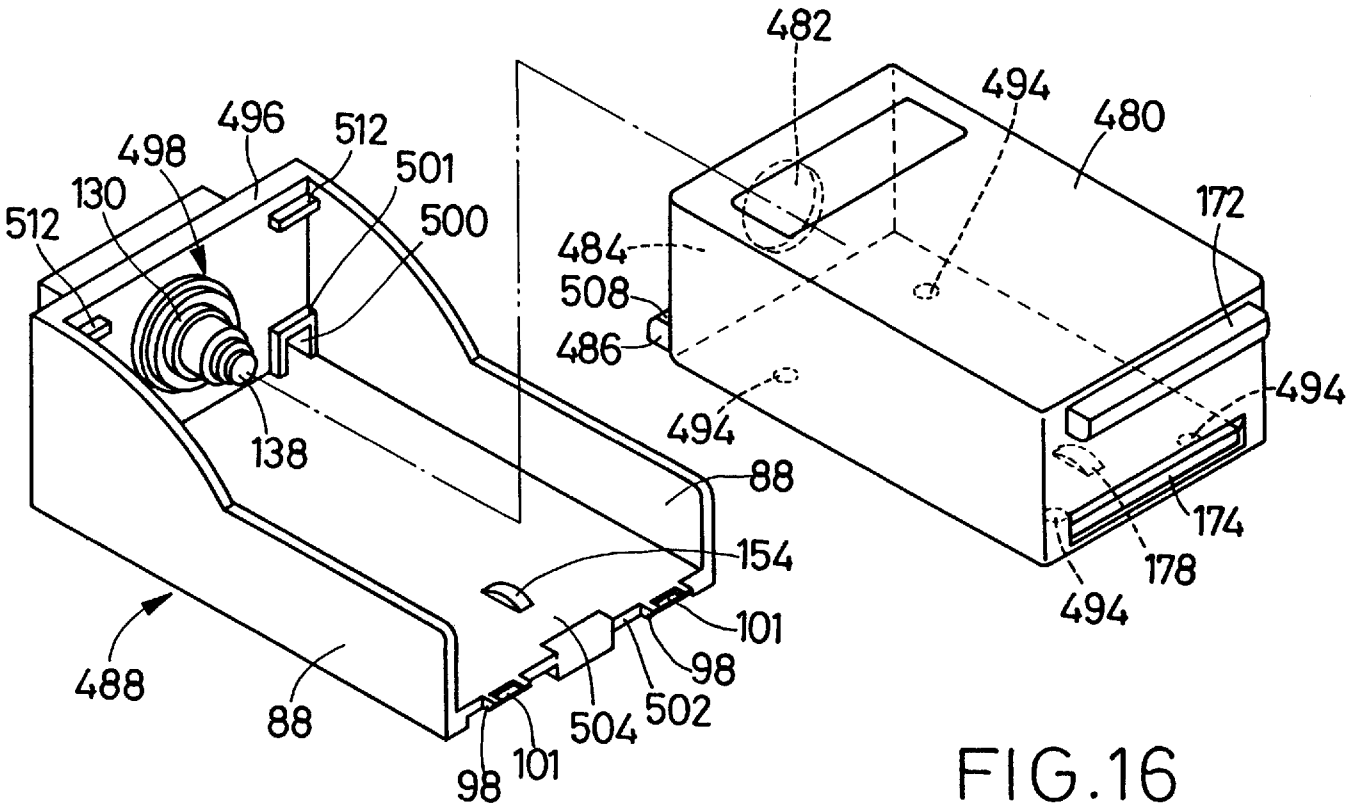
FIG. 16 is a perspective view corresponding to FIG. 5, showing an ink container and a head holder of another embodiment of the present invention.
Figure 17:
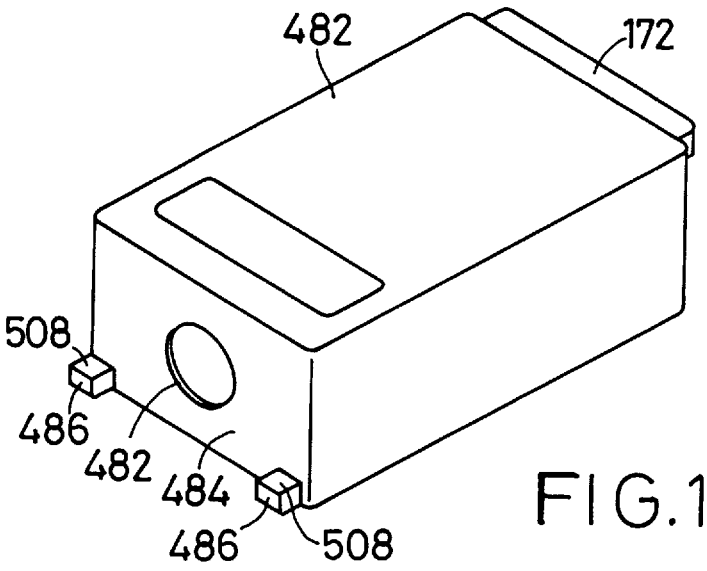
FIG. 17 is a perspective view of the ink container of FIG. 16.

FIG. 13, 14, and 15 shows a third embodiment in which two axle portions 462 (only one 462 is shown in FIG. 13 or 14) project from respective front portions of two side walls 461 of an ink container 460 which walls extend perpendicularly to a holder-movement direction, and two bearing portions 468 are formed in respective upper portions of front portions of two side walls 466 of a head holder 464 which walls extend perpendicularly to the holder-movement direction. The bearing portions 468 open in the top surfaces of the side walls 466, and are engageable with the axle portions 462 of the ink container 460.

In the third embodiment, as shown in FIG. 15, the ink container 460 is rotated relative to the head holder 464 about a rotation center, O, that is an axis line of the axle portions 462 being engaged with the bearing portions 468. A distance, R1, between a lowermost end of a porous body 138 and the rotation center O, a distance, R2, between a lowermost end of an ink outlet 162 and the rotation center O, a distance, R3, between lowermost ends of lower engageable projections 166 and the rotation center O, and a distance, R4, between an upper surface 147 of a bottom wall 86 of the head holder 464 and the rotation center O are so predetermined as to satisfy the following expression: $R1<R2<R3<R4$. Stated differently, the rotation center O is so predetermined as to satisfy the above expression.

The ink container 460 is attached to the head holder 464 in the following manner: First, the axle portions 462 are engaged with the bearing portions 468 while the ink container 460 is kept in an inclined position in which a front portion of the ink container 460 is lower than a rear portion thereof, and then the ink container 460 is rotated about the rotation center 0 in a direction in which the rear portion of the ink container 460 approaches the bottom wall 68 of the head holder 464. The porous body 138 and a cylindrical support member 130 enter the ink outlet 162 without being interfered with by the circular edge portion of the ink outlet 162.

When the lower projections 166 of the ink container 460 are brought into contact with, and supported by, the bottom wall 86 of the head holder 364, the axle portions 462 disengage from, and move up away from, respective bottom surfaces of the bearing portions 468. Then, the ink container 460 is finally attached to the head holder 464 while being guided by inner inclined surfaces 148 of engageable recesses 144 which are currently supporting the lower projections 166.

In the state in which the axle portions 462 are engaged with the bearing portions 468, the axle portions 462 are inhibited from moving in an ink jetting direction perpendicular to the axis line of the axle portions 462. Thus, the ink container 460 is prevented from disengaging from the bearing portions 468, while being rotated relative to the head holder 464. Accordingly, the user can easily rotate the ink container 460 relative to the head holder 464.

In the first, second, or third embodiment, the ink container 82, 430, 460 is attached to the head holder 80, 436, 464 by being rotated about the upper projections 164 or the axle portions 462 being engaged with the receiving portions 150 or the bearing portions 468. However, the ink container 82, 430, 460 may be rotated relative to the head holder 80, 436, 464 in a different manner.

FIGS. 16 through 20 shows a fourth embodiment in which two engageable guide projections 486 are provided on both sides of an ink outlet 482, in a lower portion of a front surface 484, of an ink container 480. The guide projections 486 function as not only guide members for guiding the ink container 480 when the ink container 480 is attached to a head holder 488, but also engageable projections which are engageable with engageable recesses 500 of the head holder 488 so that the ink container 480 is rotated relative to the head holder 488 about the projections 486 being engaged with the recesses 500.

Figure 18:
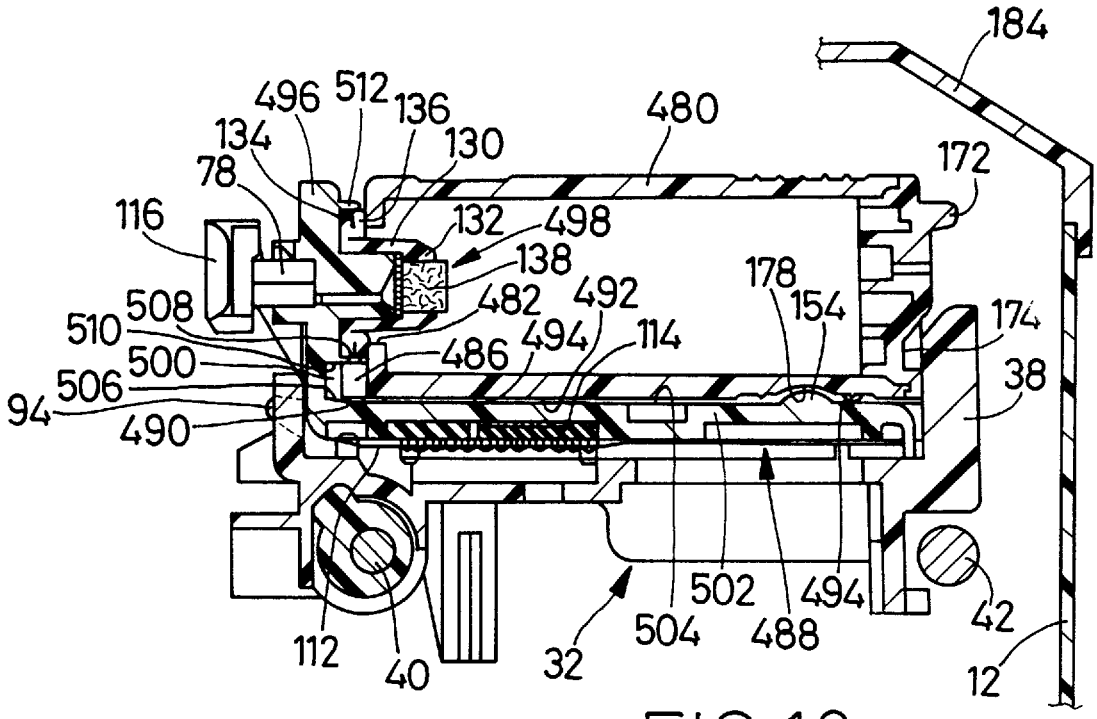
FIG. 18 is a cross-sectional elevation view of the ink container of FIG. 16 being attached to the head holder of FIG. 16.

As shown in FIG. 18, the guide projections 486 have lower surfaces 490 which are flush with a lower surface 492 of the ink container 480. The ink container 480 has four hemi-spherical support projections 494 provided on the lower surface 492. The two recesses 500 are provided on both sides of a connecting device 498, in a lower portion of a front wall 496, of the head holder 488, and have respective rear projections 501 which project rearward from around respective openings of the recesses 500.

The engageable recesses 500 which are engageable with the guide projections 486 have inner inclined surfaces 506 which are continuous with an upper surface 504 of a bottom wall 502 of the head holder 488 and which are so inclined as to climb up near respective bottom (or front) walls thereof. The projecting amount of the support projections 494, i.e., radius of the same 494 is predetermined at a value which ensures that when the ink container 480 is placed on the bottom wall 502 of the head holder 488 and the support projections 494 are supported by the upper surface 504 of the bottom wall 502, respective upper surfaces 504 of the guide projections 486 are flush with respective inner upper surfaces 510 of the engageable recesses 500. Two stopper projections 512 are provided on both sides of the connecting device 498, in an upper portion of a rear surface of the front wall 496, of the head holder 488. Each stopper projection 512 has a plate-like shape and is elongate in a holder-movement direction.

Figure 19:
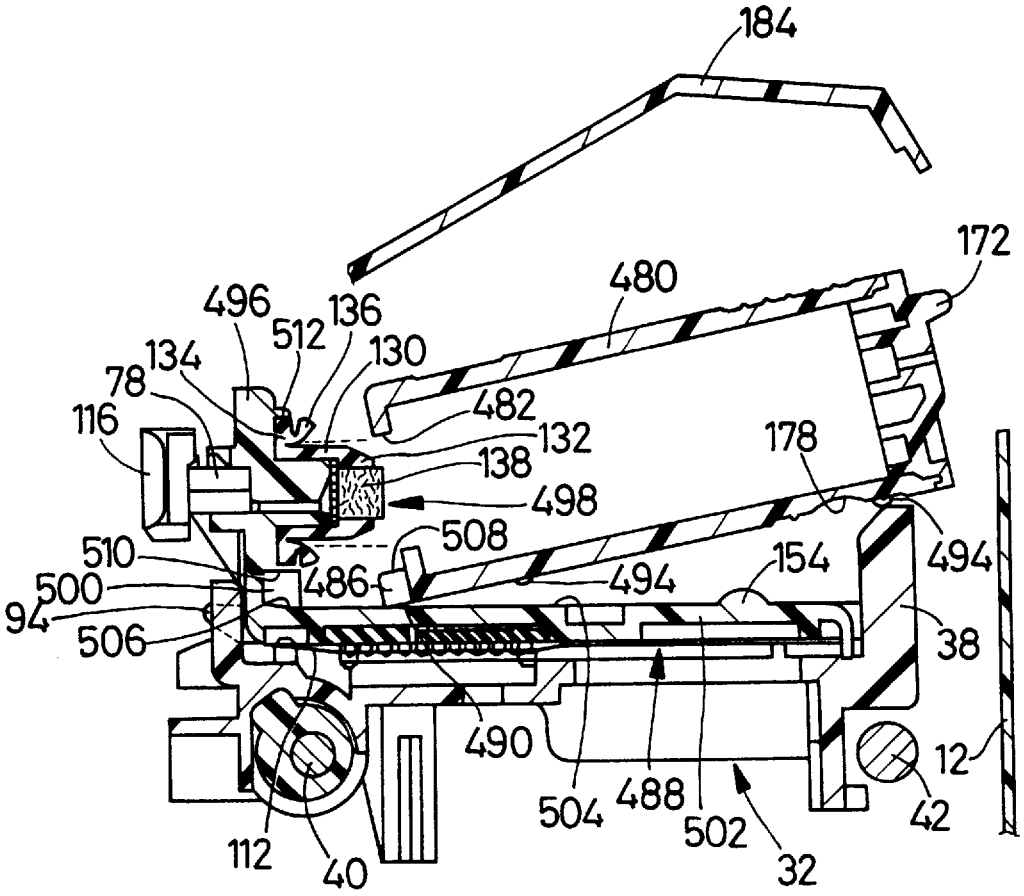
FIG. 19 is a cross-sectional elevation view for illustrating the manner in which the ink container of FIG. 16 is attached to the head holder of FIG. 16.
Figure 20:
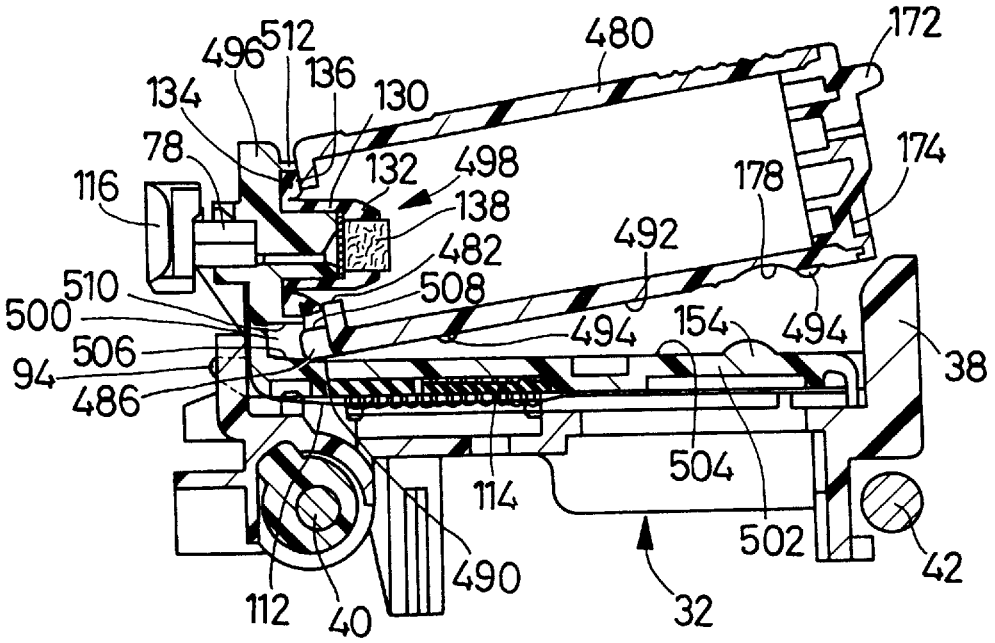
FIG. 20 is another cross-sectional elevation view for illustrating the manner in which the ink container of FIG. 16 is attached to the head holder of FIG. 16.

As shown in FIG. 19, when the ink container 480 is attached to the head holder 488, first, a cover member 184 is opened by a user, and then the ink container 480 is put in a casing 12 while taking an inclined position in which a front portion of the ink container 480 is lower than a rear portion of the same 480. Thus, the guide projections 486 are contacted with the upper surface 504 of the bottom wall 502 of the head holder 488. In this state, the ink container 480 is advanced toward the front wall 496 of the head holder 488 till the front surface 484 of the ink container 480 abuts on the stopper projections 512. Thereafter, the ink container 480 is rotated in a direction in which the rear portion thereof approaches the bottom wall 502.

If the guide projections 486 which project frontward from the front surface 484 of the ink container 480 were not provided, an elevation level or position of the ink outlet 482 when the ink container 480 taking the inclined position contacts the bottom wall 502 might be lowered, and an upper edge portion of the ink outlet 482 would be interfered with by a cylindrical support member 130 and/or a porous body 138 of the connecting device 498. However, in the fourth embodiment, since the guide projections 486 are provided on the front surface 484 of the ink container 480 and contact the upper surface 504 of the head holder 488, the position of the ink outlet 482 relative to the connecting device 498 when the ink container 480 contacts the bottom wall 502 is raised as indicated in broken line in FIG. 19. Therefore, the ink outlet 482 is effectively prevented from being interfered with by the support member 130 and/or the porous body 138.

Because of the provision of the guide projections 486, the upper edge portion of the ink outlet 482 of the ink container 480 which is taking the inclined position relative to the bottom wall 502, is well kept away from the connecting device 498 while the ink container 480 is held in contact with the bottom wall 502 of the head holder 488. In this state, a lower edge portion of the ink outlet 482 is positioned below a tapered end portion 132 of the support member 130, and is effectively prevented from being interfered with by the support member 130.

After the ink container 480 abuts on the stopper projections 512, the ink container 480 is rotated toward the bottom wall 502 of the head holder 488 so as to approach an operative position thereof in which the ink container 480 is attached to the head holder 480. Accordingly, the position of the ink outlet 482 is lowered so that the upper edge portion of the ink outlet 482 approaches the support member 130. However, after the guide projections 486 are engaged with the inner lower inclined surfaces 506 of the engageable recesses 500, the ink container 480 is lifted up by being guided by the inclined surfaces 506. In the final, operative position of the ink container 480, a horizontal axis line of the ink outlet 482 substantially coincides with a horizontal axis line of the connecting device 498, as if the ink container 480 were attached to the head holder 488 while taking a horizontal position relative to the bottom wall 502 of the head holder 488. While all the four support projections 494 of the ink container 480 abut on, and are supported by, the upper surface 504 of the bottom wall 502 of the head holder 488, the upper surfaces 508 of the guide projections 486 are held in contact with the inner upper surfaces 510 of the engageable recesses 500, so that the ink container 480 is prevented from bouncing on the head holder 488.

Provided that the angle of inclination of the inclined position taken by the ink container 480 when the ink container 480 contacts the bottom wall 502 of the head holder 488, is not changed, the longer the guide projections 486 of the ink container 480 are, the more the position of the ink outlet 482 relative to the connecting device 498 is raised. As shown in FIG. 19, when the ink container 480 is attached to the head holder 488, it is convenient to incline the ink container at a constant angle, by putting the rear portion of the same 480 on a top surface of a rear wall 38 of a carriage 32. Therefore, the front-rear-direction length of the guide projections 486 can be pre-determined such that while the rear portion of the ink container 480 is held in contact with the top surface of the rear wall 38 and the projections 486 are held in contact with the upper surface 504 of the bottom wall 502, the ink outlet 482 are not interfered with by the support member 130 and/or the porous body 138.

Although the guide projections 480 project frontward from the front surface 484 of the ink container 480, the overall size of the ink jetting apparatus 30 does not become larger. The front wall 90 of the head holder 488 supports an ink jetting head 78 and, even if the guide projections 486 are provided in front of the front surface 484 of the ink container 480, a front-rear-direction dimension of the head holder 488 does not increase.

The fourth embodiment shown in FIGS. 16–20 enjoys the same advantages as those with the first embodiment shown in FIGS. 1–10, e.g., the improved degree of freedom of designing of the cover member 184, and the simplified construction of a clamping device 64 for clamping the head holder 488 to the carriage 32 or a clamping device 58 for clamping the ink container 480 to the head holder 488, because of the manner in which the ink container 480 is attached to the head holder 488 through the rotation of the former relative to the latter from the inclined position of the former; and the prevention of bouncing of the ink container 480 on the head holder 488, the prevention of leaking of the ink from the ink container 480, and the prevention of ill-influenced control of the movement speed of the ink jetting apparatus 30, because of the secure engagement of the guide projections 486 with the engageable recesses 500.

As described previously, the guide projections 486 are provided on both sides of the ink outlet 482 on the front surface 484 of the ink container 480, and the lower surfaces 490 of the projections 486 are flush with the lower surface 492 of the ink container 480. Since the ink container 480 can well be balanced while taking the inclined position, the user can easily attach the ink container 480 to the head holder 488. The guide projections 486 project from the lower end portion of the front surface 484 of the ink container 480 which portion is the nearest to the bottom wall 502 of the head holder 488. The guide projections 486 have a sufficient length which ensures that the projections 486 are securely engaged with the engageable recesses 500. The upper surface 504 of the bottom wall 502 of the head holder 488 functions as a guide surface which supports and guides the guide projections 486.

When the ink container 480 is contacted with the upper surface 504 of the bottom wall 502 of the head holder 488, the ink container 480 is sandwiched by two side walls 88 of the head holder 488, so that the ink container 480 is securely positioned in the holder-movement direction parallel to the direction of width of the head holder 488. That is, the position of the ink outlet 482 relative to the position of the connecting device 498 in the direction of width of the ink container 82 is not changed. Thus, the guide projections 486 can easily be introduced into the engageable recesses 500. In addition, the ink container 480 can be rotated with stability relative to the head holder 488 about the guide projections 486 engaged with the recesses 500. Thus, the ink container 480 is easily attached to the head holder 488.

Thus, the two side walls 88 of the head holder 488 function as positioning portions, and respective inner surfaces of the two side walls 88 function as positioning surfaces each of which extends perpendicularly to the upper surface 504 of the head holder 488 which surface functions as the guide surface for supporting and guiding the guide projections 486 of the ink container 480. When the ink container 480 is attached to the head holder 488, the guide projections 486 are first contacted with the upper surface 504 of the head holder 488. Since the positioning surfaces are provided adjacent the upper surface 504, the guide projections 486 are automatically positioned in the direction of width of the ink container 480 when the guide projections 486 are contacted with the upper surface 504. Subsequently, the ink container 480 is just moved or slid on the upper surface 504 by being guided by the two side walls 88 so as to fit in the recesses 500, and is rotated relative to the head holder 488 about the guide projections 486 engaged with the recesses 500. Thus, the ink container 480 is easily attached to the head holder 488.

Since the engagement of the guide projections 486 and the upper surface 504 continue while the ink container 480 is rotated relative to the head holder 488, the same positioning surfaces operate not only when the ink container 480 is moved on the upper surface 504 but also when the same 480 is rotated relative to the head holder 488.

In the fourth embodiment, the guide projections 486 are provided on the lower end portion of the front surface 484 of the ink container 480, such that the lower surfaces 490 of the projections 486 are flush with the lower surface 492 of the ink container 480, and the guide projections 486 are guided by the bottom wall 502 of the head holder 488. However, the ink container 480 may be guided by the head holder 488 in a different manner.

Figure 21:
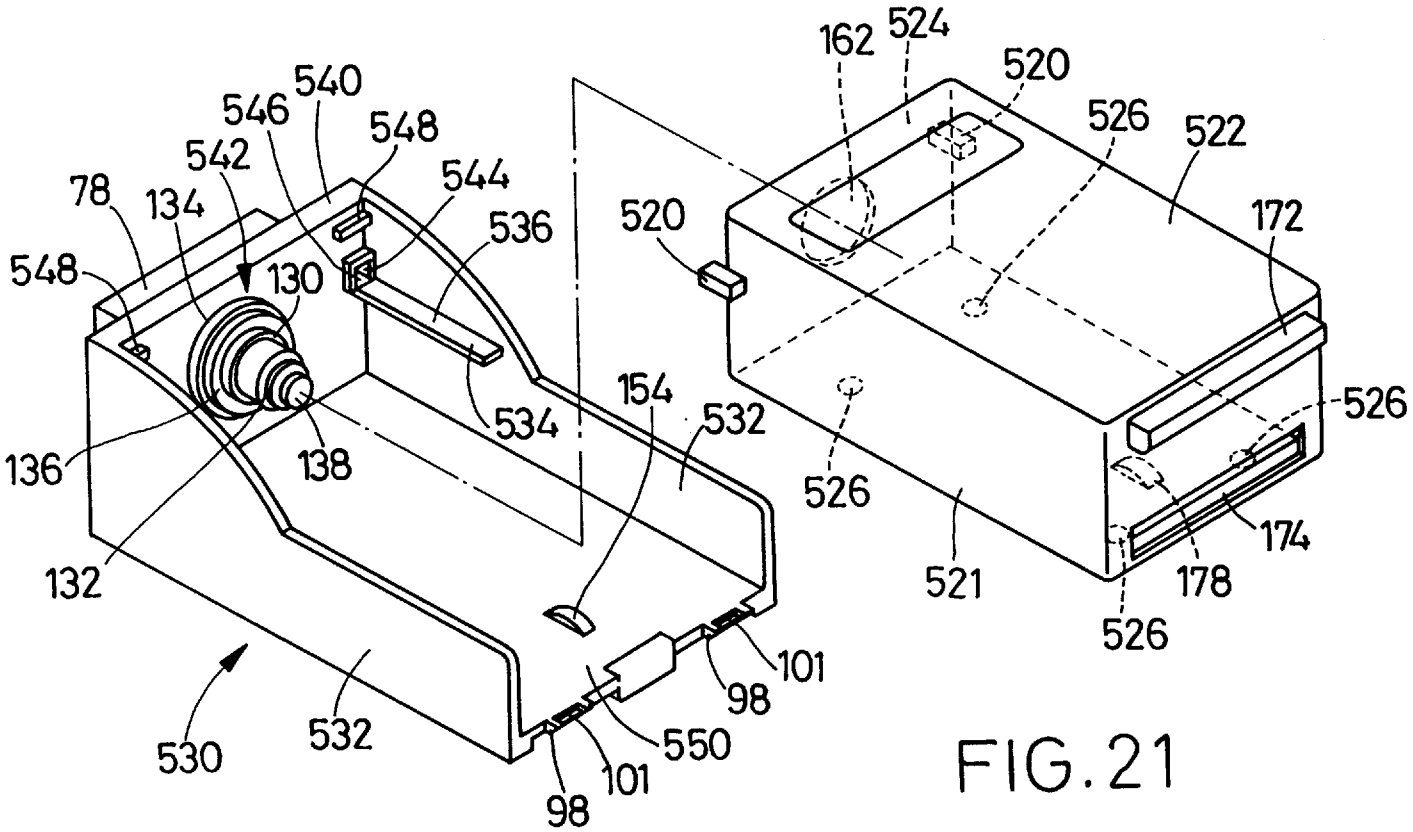
FIG. 21 is a perspective view corresponding to FIG. 5, showing an ink container and a head holder of another embodiment of the present invention.

FIG. 21 shows a fifth embodiment in which two guide projections 520 are provided on an intermediate portion of a head-side portion of an ink container 522 which portion is connected to an ink jetting head 78 by a connecting device 542. The two guide projections 520 project from intermediate positions on two side walls 521 of the ink container 522 which extend perpendicularly to a direction of movement of a head holder 530, and respective front ends of the guide projections 520 extend beyond a front surface 524 of the ink container 522. Four hemi-spherical support projections 526 are provided on a lower surface of the ink container 522.

Two guide plates 534 are provided on respective front portions of inner surfaces of two side walls 532 of the head holder 530 which extend perpendicularly to the holder-movement direction. The two guide plates 534 extend parallel to each other in a front-rear direction of an ink jetting apparatus 30. Respective upper surfaces 536 of the guide plates 534 function as guide surfaces for supporting and guiding the guide projections 520 of the ink container 522. Elevation levels or positions of the guide surfaces 536 are so pre-determined that when the guide projections 520 are moved frontward on the guide plates 534, a center of an ink outlet 162 of the ink container 522 substantially coincides with an axis line of the connecting device 542. Two engageable recesses 544 are formed on both sides of the connecting device 542 in a front wall 540 of the head holder 530, such that the two recesses 544 are remote from each other in the holder-movement direction. Respective inner lower surfaces 546 of the recesses 544 are continuous with the corresponding guide surfaces 536, and are inclined with respect to the guide surfaces 536 so as to climb up toward respective front (i.e., bottom) surfaces of the recesses 544. Two stopper projections 548 are provided on a rear surface of the front wall 540 of the head holder 530, at two positions which are on both sides of the connecting device 542, and are remote from each other, in the holder-movement direction. The stopper projections 548 project rearward from the front wall 540.

When the ink container 522 is attached to the head holder 530, first, the ink container 522 is held by a user to take an inclined position in which a front portion thereof is lower than a rear portion thereof, and the free ends of the guide projections 520 are contacted with the guide surfaces 546, respectively.

Subsequently, the ink container 522 is moved frontward till the ink container 522 abuts on the stopper projections 548. The positions of lower surfaces, and the dimensions, of the guide projections 520 are so predetermined that when the ink container 522 is moved frontward on the guide surfaces 536 and is rotated about the guide projections 520 engaged with the engageable recesses 544, a porous body 138 and a support member 130 smoothly enter the ink outlet 162 without being interfered with by a peripheral edge portion of the ink outlet 162.

A position of an upper edge portion of the ink outlet 162 is lowered when the ink container 522 taking the inclined position is rotated relative to the head holder 530. However, the amount of lowering of the upper edge portion of the ink outlet 162 is smaller than that of the ink outlet 162 in the fourth embodiment shown in FIGS. 16–20 in which the guide projections 486 are provided in the lower end portion of the ink container 480. Therefore, the amount of frontward projection of the guide projections 520 from the front surface 524 of the ink container 522 may be shorter than that of the guide projections 486. On the other hand, the guide projections 520 should have a sufficient length which ensures that the projections 520 are securely engaged with the engageable recesses 544 so as to prevent the ink container 522 from bouncing on the head holder 530. Hence, it is preferred that lower surfaces of the free end portions of the guide projections 520 be cut off to provide inclined surfaces so that the inclined surfaces may not be contacted with the guide surfaces 536.

In the fifth embodiment, after the ink container 522 is moved frontward till the ink container 522 contacts the stopper projections 548, the ink container 522 is rotated in a direction toward a bottom wall 550 of the head holder 530. In this step, the position of the upper edge portion of the ink outlet 162 is lowered. However, after the guide projections 520 are engaged with the inner inclined surfaces 546 of the recesses 544, the projections 520 are lifted up by being guided by the inclined surfaces 546, as the ink container 522 is rotated relative to the head holder 530. Thus, the ink container 522 is attached to the head holder 530 in such a manner that the axis line of the ink outlet 162 substantially coincides with that of the connecting device 498, as if the former 522 were attached to the latter 530 while taking a horizontal position. The ink container 522 are supported, at the support projections 526, on the upper surface 552 of the bottom wall 550, and respective upper surfaces of the guide projections 520 are held in contact with inner upper surfaces of the recesses 544, so that the ink container 522 is prevented from bouncing on the head holder 530.

The front wall 540 and the bottom wall 550 of the head holder 530 extend perpendicularly to each other, and the guide projections 520 are provided at an elevation level which substantially coincides with that of the center of the ink outlet 162. When the ink container 522 is inclined with the guide projections 486 being supported on the guide surfaces 536, both the upper and lower edge portions of the ink outlet 162 approach the connecting device 542. However, the user can easily select such an angle of inclination of the ink container 522 which ensures that the ink container 522 is attached to the head holder 530 without being interfered with by the connecting device 542.

If the guide surfaces 536 of the guide plates 534 are provided at the same elevation level as that of the upper edge portion of the ink outlet 162, the position of the upper edge position of the ink outlet 162 is not lowered even when the ink container 522 takes an inclined position. Therefore, the guide projections 520 need not project frontward from the front surface 524 of the ink container 522. Thus, the ink container 522 may be guided by the head holder 530 in a different manner.

Figure 22:
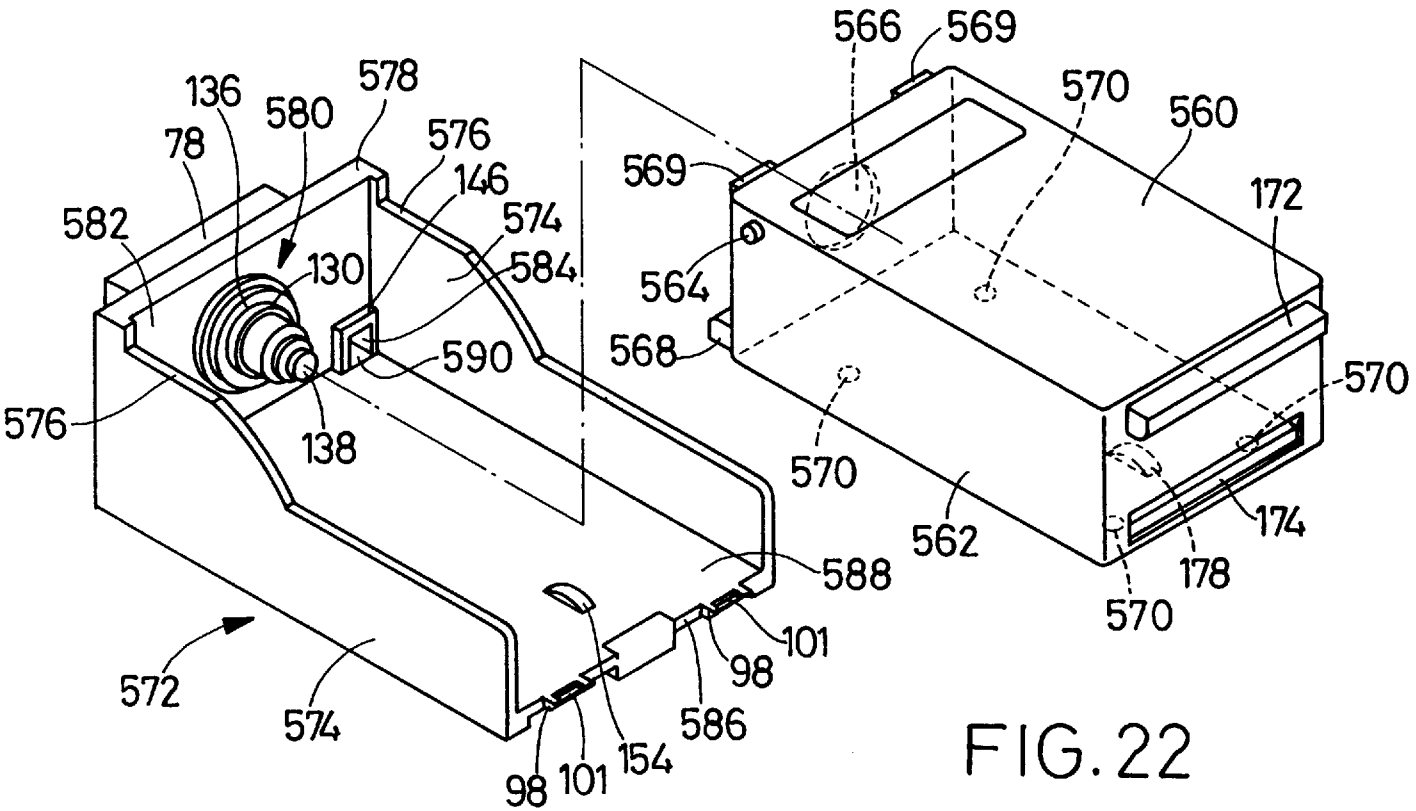
FIG. 22 is a perspective view corresponding to FIG. 5, showing an ink container and a head holder of yet another embodiment of the present invention.

FIG. 22 shows a sixth embodiment in which an ink container 560 has two axle portions 564 which project laterally from front end portions of two side walls 562 of the ink container 560 which extend perpendicularly to a direction of movement of a head holder 572, and the two axle portions 564 are supported and guided by two top, guide surfaces 576 of the head holder 572, respectively.

The axle portions 564 are provided such that a common axis line thereof is located at the same elevation level as that of an upper edge portion of an ink outlet 566. Two lower engageable projections 568 are provided on both sides of the ink outlet 566 in a lower end portion of a front surface of the ink container 560, and project frontward from the front surface of the same 560. Two stopper projections 569 are provided on both sides of the ink outlet 566 in an upper end portion of the front surface of the ink container 560, and project frontward from the front surface of the same 560. Four support projections 570 are provided on a lower surface of the ink container 560.

The two guide surfaces 576 are formed by cutting off respective upper end portions of front end portions of two side walls 574 of the head holder 572, such that the guide surfaces 576 extend parallel to each other and parallel to a front-rear direction. An elevation level of the guide surfaces 576 is lower than that of the axis line of the axle portions 564 by an amount greater than a radius of the same 564. With the ink container 560 being attached to the head holder 572, the axle portions 564 are kept away from the guide surfaces 576. Two engageable recesses 584 are formed on both sides of a connecting device 580 in a lower end portion of a rear surface 582 of a front wall 578 of the head holder 572. The two recesses 584 have respective inner lower surfaces 590 which are continuous with an upper surface 588 of a bottom wall 586 of the head holder 572 and are inclined with respect to the upper surface 588 so as to climb up toward respective front (bottom) wall surfaces of the recesses 584. Therefore, a dimension of each recess 584 in a direction perpendicular to the front-rear direction and the holder-movement direction gradually decreases in the front-rear direction, i.e., direction of depth of a corresponding recess 584 from an opening of the same 584 adjacent the upper surface 588.

When the ink container 560 is attached to the head holder 572, first, the ink container 560 is held by a hand of the user to take an inclined position in which a front portion thereof is lower that a rear portion thereof, and then the axle portions 564 are placed on the guide surfaces 576. While taking this position, the ink container 560 is moved frontward till the stopper projections 569 abut on the rear surface 582 of the front wall 578 of the head holder 572. Subsequently, the ink container 560 is rotated and placed on the head holder 572. Since the axis line of the axle portions 564 is aligned with the uppermost end of the ink outlet 566, a porous body 138 and a cylindrical support member 130 enter the ink outlet 566 without being interfered with by the circular edge portion of the ink outlet 566, when the ink container 560 is moved frontward, and rotated, on the guide surfaces 576. When the lower projections 568 enter the engageable recesses 584 and are engaged with the inner inclined surfaces 590, the axle portions 564 are disengaged from the guide surfaces 576. Thereafter, the projections 568 are guided by the inclined surfaces 590, so that the ink container 560 is moved frontward while slightly being lifted up because of the inclination of the inclined surfaces 590. Thus, the ink container 560 is placed on the head holder 572 such that the support projections 570 are held in abutment on, and supported by, the upper surface 588 of the bottom wall 586. In this state, the lower projections 568 are engaged with the recesses 584, respectively, such that upper surfaces of the projections 568 are held in contact with inner upper surfaces of the recesses 584. Thus, the ink container 560 is prevented from bouncing on the head holder 572.

In the sixth embodiment shown in FIG. 22, the stopper projections 569 provided on the front surface of the ink container 560 may be replaced by vertical surfaces which vertically extend from respective front ends of the guide surfaces 576 of the head holder 572. In the latter case, when the ink container 560 is moved frontward on the guide surfaces 576, the above vertical surfaces function as stoppers for stopping the frontward movement of the ink container 560.

Alternatively, the stopper projections 569 may be omitted and the frontward movement of the ink container 560 may be stopped by abutment of the front surface of the ink container 560 on an elastic flange portion 136 of the rubber-based support member 130 of the connecting device 580.

In each of the first to sixth embodiments, the ink jetting apparatus 30 includes the single ink container 82, 430, 460, 480, 522, 560 providing a cartridge which is detachably attached to the head holder 80, 436, 464, 488, 530, 572 providing a cartridge holder. Thus, the ink jetting apparatus 30 records, on the recording sheet 28, images in a single color of the ink jetted thereby. However, the present invention is applicable to an ink jetting apparatus 620 of a full-color ink-jet printer, shown in FIG. 23, which includes four ink containers 622 containing cyan, magenta, yellow, and black inks, respectively.

The ink jetting apparatus 620 includes a carriage 624 which supports four head holders 626 which are arranged in an array extending in a direction parallel to a direction of movement of the carriage 624 or the head holders 626 themselves by a moving device (not shown) similar to the moving device 30 shown in FIG. 1. Each of the head holders 626 has an ink jetting head (not shown) similar to the ink jetting head 78 shown in FIG. 2. Each head holder 626 additionally has a positioning-related engageable projection 628 projecting from a bottom wall thereof. Each of the ink containers 622 has a positioning-related engageable projection (not shown) which is distant in an ink jetting direction from the positioning-related engageable projection 628 of a corresponding head holder 626 by a distance greater than a dimension of each ink container 622 in the holder-movement direction, as is the case with the second embodiment shown in FIGS. 11 and 12. However, each of the four head holders 626 has the projection 628 located at a corresponding one of four different positions thereof in the holder-movement direction.

Each of the four ink containers 622 has a positioning-related engageable recess 630 which opens in a lower surface thereof and which is engageable with the positioning-related engageable projection 628 of a corresponding one of the four head holders 626. Each of the four ink containers 622 has the recess 630 located at a corresponding one of four different positions thereof in the holder-movement direction which correspond to the four different positions of each of the four head holders 626, respectively. Thus, an ink container 622 containing a specific one of the four different color inks must be attached to a head holder 626 having an appropriate ink jetting head to jet the specific color ink.

The ink containers 622 attached to the head holders 626 are prevented from being moved in the holder-movement direction because of the engagement of the positioning-related engageable projections and recesses 628, 630. Since the respective positions of the four projections or recesses 628, 630 are different from each other in the holder-movement direction, the user cannot attach each ink container 622 to an incorrect head holder 626, i.e., must attach each ink container 622 to a correct head holder 626. Thus, the present ink jetting apparatus 620 can record images with correct color inks.

Figure 23:
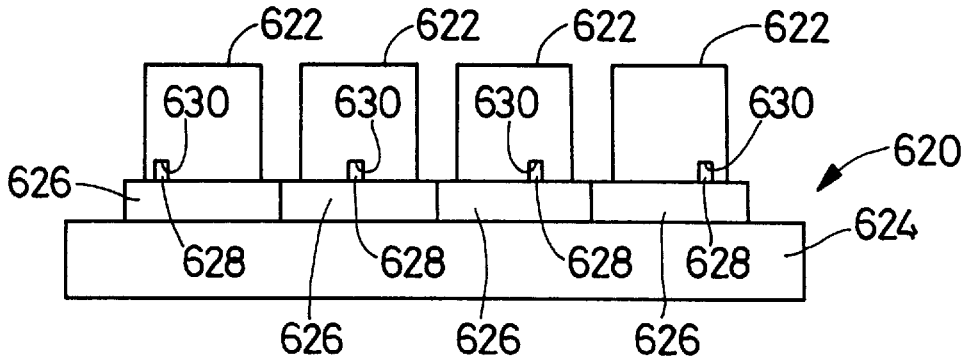
FIG. 23 is a schematic elevation view of ink containers and head holders of yet another embodiment of the present invention.
Figure 24:
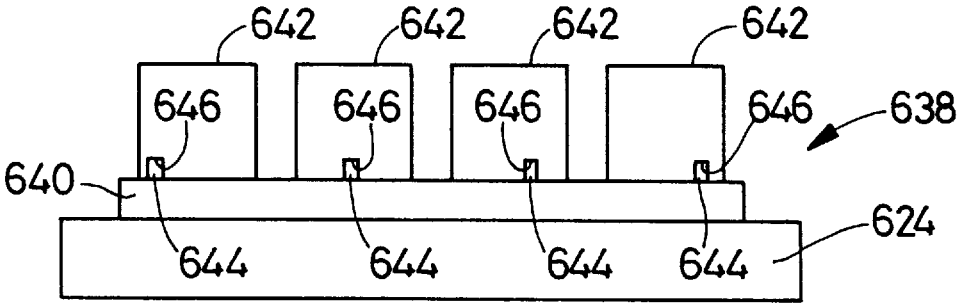
FIG. 24 is a schematic elevation view of ink containers and a head holder of yet another embodiment of the present invention.

FIG. 24 shows an eighth embodiment in which a single head holder 640 has four ink-jetting heads which jet four different color inks, and supports four ink containers 642, unlike the seventh embodiment shown in FIG. 23 in which each of the four head holders 626 supports a corresponding one of the four ink containers 622 of different sorts.

The head holder 640 has four positioning-related engageable projections 644 which project from an upper surface of a bottom wall thereof and each of which is located at a corresponding one of different four positions of a corresponding one of four ink-container attachment areas or ranges of the head holder 640 in a holder-movement direction. Each of the four ink containers 642 has a positioning-related engageable recess 646 which opens in a lower surface thereof and which is engageable with a corresponding one of the four positioning-related engageable projections 644 of the head holder 626. Each of the four ink containers 642 has the recess 646 located at a corresponding one of four different positions thereof in the holder-movement direction which correspond to the four different positions of each of the four ink-container attachment areas of the head holder 626, respectively. Thus, an ink container 642 containing a specific one of the four different color inks must be attached to an ink-container attachment area corresponding to an appropriate ink jetting head to jet the specific color ink.

In the illustrated embodiments, the head holder 80, 436, 464, 488, 530, 572 has the front wall 90, 496, 540, 578 which supports the ink jetting head 78 and the connecting device 142, 498, 542, 580, and the bottom wall 86, 438, 502, 550, 586 which extends at a right angle from the front wall and holds the ink container 82, 430, 460, 480, 522, 560. However, the head holder may have a front and a bottom wall which extend in respective planes intersecting each other at an acute or an obtuse angle different from the right angle.

The present invention is applicable to an ink jetting apparatus in which an ink jetting head and an ink container are supported and held by a common portion or member. For example, in an ink jetting apparatus which jets ink downward, a portion or member which supports an ink jetting head and also supports a connecting device such that the connecting device projects upward, is also used for holding an ink container such that the ink container takes a vertical position. This ink jetting apparatus may include an ink container and a head holder which have structural elements or parts similar to the positioning-related engageable projections 154, 434, 628, 644 and the positioning-related engageable recesses 178, 442, 630, 646 and/or the engageable projections 164, 462, 486, 520, 564 and the engageable recesses 150, 468, 500, 544, 576 all of which are shown in the illustrated embodiments.

In the first embodiment shown in FIGS. 1–10, the ink container 82 initially takes a vertical position in which the ink container 82 extends perpendicularly to the bottom wall 86 of the head holder 80, as shown in two-dot chain line in FIG. 9, when the ink container 82 is attached to the head holder 80. However, this is not essentially required. The ink container 82 takes any inclined position so long as the inclined position permits the upper engageable projections 164 to be engaged with the receiving portions 150. The cover member 184 is provided to cover an opening of the casing 12 which is located depending upon the angle of inclination of the initial inclined position taken by the ink container 82. Thus, the ink-jet printer enjoys a high degree of freedom of designing of the cover member 184.

In the illustrated embodiments, the ink container 82, 430, 460, 480, 522, 560 are attached to the head holder 80, 436, 464, 488, 530, 572 while being positioned, in a direction parallel to the axis line of rotation of the ink container relative to the head holder, by the two side walls 88, 466, 532, 574. However, this positioning may be achieved in a different manner. For example, in the first embodiment shown in FIGS. 1–10, each of the receiving portions 150 may be replaced by a recess which opens in the upper and rear surfaces of the front wall 90 of the head holder 80 and with which a corresponding upper projection 164 is engageable. In the latter case, two side walls defining each recess function for positioning the ink container 82 in the holder-movement direction.

Alternatively, it is possible that each of the upper projections 164 be provided with a recess and each of the receiving portions 150 be provided with a projection which is engageable with the recess of each projection 164. In this case, too, the ink container 82 is securely positioned in the holder-movement direction.

When the ink container 82 is attached to the head holder 80, first, the upper projections 164 and the receiving portions 150 are engaged with each other. In the case where the receiving portions 150 are provided with positioning means, the ink container 82 is automatically positioned relative to the head holder 80 in the direction of width thereof when the upper projections 164 are engaged with the receiving portions 150. Then, the ink container 82 is easily attached to the head holder 80 by simply being rotated relative to the head holder 80.

The above positioning means may be provided by considerably small-size structural elements because the upper projections 164 and the receiving portions 150 are substantially immovable relative to each other in the ink jetting direction when the ink container 82 is rotated relative to the head holder 80.

Thus, the side walls 88, 466 which are used to position the ink container 82, 430, 460 in the direction parallel to the axis line of rotation of the ink container relative to the head holder 80, 436, 464 may be replaced by positioning projections which are provided adjacent the upper projections 164 or the receiving portions 150 in the first or second embodiment, or the axle portions 462 or the bearing portions 468 in the third embodiment. In the latter case, the positioning projections may be provided by considerable small-size elements, so long as they have a sufficient mechanical strength. Thus, the overall construction and weight of the head holder may be simplified and reduced, respectively.

In addition, the side walls 88, 466 which are used to position the ink container 82, 430, 460 in the direction of width thereof when the ink container is attached to the head holder 80, 436, 464 may be replaced by short ribs which stand upright along the opposite side edges of the head holder which extend in the front-rear direction of the head holder. The side walls extend upward from the bottom wall 86, 438 of the head holder and have a height comparable to an upper end portion of the ink container. Thus, the side walls function as not only positioning means for positioning the ink container in the direction of width thereof but also reinforcing means for reinforcing the head holder. However, in the case where the head holder has a sufficient mechanical strength without needing the side walls, a pair of short ribs may be used simply as positioning means for positioning the ink container when the ink container is attached to the head holder. Since the projections or axle portions 164, 462 and the receiving portions or bearing portions 150, 468 are substantially immovable relative to each other in the front-rear direction when the ink container is rotated relative to the head holder, the positioning means may be provided by considerably small positioning surfaces.

In addition, the above positioning means may be provided on either the bottom wall 86, 438 of the head holder or the front wall 90 of the same. In either case, the positioning means may be provided by positioning surfaces which are perpendicular to the upper surface of the bottom wall of the head holder.

In the fourth to sixth embodiments shown in FIGS. 16–22, the ink container 480, 522, 560 is moved frontward while the projections or axle portions 486, 520, 564 are guided by the bottom-wall surfaces or guide surfaces 504, 544, 576, and subsequently is rotated relative to the head holder 488, 530, 572 at a position where the frontward movement of the ink container is stopped. In those embodiments, the connecting device 498, 542, 580 need not have the elongate shape or the tapered end portion. If the distance between the ink outlet 482, 162, 566 and the connecting device in the radial direction thereof is considerably large, the ink outlet and the connecting device do not interfere with each other even if a lower edge portion of the ink outlet on the side of the bottom wall 502, 550, 586 of the head holder approaches the connecting device when the ink container taking an inclined position is attached to the head holder.

In addition, if the connecting device 142, 498, 542, 580 is short in the front-rear direction, a lower edge portion of the ink outlet of the ink container 82, 430, 460, 480 522, 560 on the side of the bottom wall of the head holder 80, 436, 464, 488, 530, 572 does not interfere with the connecting device when the ink container is attached to the head holder. When the ink container is rotated to a position near the operative position thereof in which the ink container is placed on the head holder, the lower edge portion of the ink outlet of the ink container approaches the connecting device. In this situation, the ink container is not inclined, i.e., is taking a substantially horizontal position. Therefore, the ink container is attached to the head holder without interference between the ink outlet and the connecting device.

In the illustrated embodiments, the inclined lower surfaces 148, 506, 546, 590 of the engageable recesses 144, 500, 544, 584 are flat. However, those inclined surfaces may be provided by curved surfaces such as part-cylindrical surfaces. In addition, the upper surfaces of the bottom walls 86, 438, 502, 550, 586 which are continuous with the inclined surfaces may include inclined portions adjacent the inclined surfaces such that the inclined portions gradually climb up toward the inclined surfaces. Alternatively, the inclined surfaces may include horizontal portions continuous with the upper surfaces of the bottom walls, and inclined portions which are continuous with the horizontal portions and gradually climb up in a direction away from the openings thereof adjacent the bottom walls.

As the ink container 480, 522, 560 are rotated toward the operative position after the projections 486, 520, 568 are engaged with the inclined surfaces of the recesses 500, 544, 584, the positions where the projections 486, 520, 568 are engaged with the inclined surfaces move away from the bottom wall 502, 550, 588 of the head holder. The possible interference between the ink outlet 482, 162, 566 and the connecting device 498, 542, 580 can be avoided by taking into account the changing of positions of the upper and lower edge portions of the ink outlet because of the decreasing of angle of inclination of the front surface of the ink container during the rotation of the ink container.

The above arrangement is particularly advantageous with the case where the support projections 494 provided on the lower surface of the ink container 480 are not provided near the front surface of the ink container and simultaneously the projections 486 are engageable with the inclined surfaces 506 of the recesses 500 which are continuous with the upper surface of the bottom wall 502 of the head holder 488. Alternatively, the above arrangement may be provided by taking into account the support projections 494.

In the illustrated embodiments, the amount of projection of the support projections 180, 494, 526, 570 are predetermined such that while the ink container 82, 430, 460, 480, 522, 560 takes the operative position in which the support projections are held in abutment on the bottom wall of the head holder 80, 436, 464, 488, 530, 572, the upper surfaces of the lower or guide projections 166, 486, 520, 568 are held in contact with the inner upper surfaces of the engageable recesses 144, 500, 544, 584. However, it is possible to modify the above arrangement such that while the ink container takes the operative position, the upper surfaces of the projections 166, 486, 520, 568 are located slightly away from the inner upper surfaces of the engageable recesses so as to substantially prevent the ink container from moving off the head holder in a vertical direction, or such that the ink container is elastically slightly deformed and the lower or guide projections are elastically pressed against the inner upper surfaces of the engageable recesses.

It is not essentially required to provide the support projections 180, 494, 526, 570 on the lower surface of the ink container 82, 430, 460, 480, 522, 560 so that while the ink container takes the operative position, the support projections are held in abutment on the upper surface of the bottom wall of the head holder 80, 436, 464, 488, 530, 572. The support projections may be omitted, so that the lower surface of the ink container is directly supported by the upper surface of the bottom wall of the head holder.

In the above-indicated case where the ink container is directly supported by the head holder without providing any support projections therebetween, it is possible to provide the projections 166, 487, 520, 568 and the recesses 144, 500, 544, 584, with high accuracy, such that while the ink container takes the operative position, the upper and lower surfaces of the projections are held in contact with the inner upper and lower surfaces of the recesses, respectively. In the last case, the ink container is effectively prevented from moving up in a vertical direction relative to the head holder. In addition, the ink container and the head holder may have positioning-related engageable projection and recess similar to the projection and recess 154, 178 shown in FIG. 5, so that the positioning-related projection and recess engaged with each other position the ink container relative to the head holder in the holder-movement direction.

In the illustrated embodiments, an inner dimension of the engageable recesses 144, 500, 544, 584 in a first direction perpendicular to the ink jetting direction and the direction of width of the head holder 80, 436, 464, 488, 530, 572 decreases in a second direction away from the openings thereof adjacent the bottom wall of the head holder, because the inner lower surfaces 148, 506, 546, 590 are inclined to climb up in the first direction. Alternatively, the inner upper surfaces of the recesses may be inclined to hang down in the first direction so that the inner dimension in question decreases in the second direction.

In the illustrated embodiments, the head holder or holders 80, 436, 464, 488, 530, 572, 626, 640 is/are detachably attached to the carriage 32, 624. The present invention is applicable to an ink jetting apparatus including a head holder which is formed integrally with a carriage. In the latter case, the carriage provides part of the head holder.

The clamping devices 56 for clamping the ink container 82, 430, 460, 480, 522, 560, 622, 642 to the head holder 80, 436, 464, 488, 530, 572, 626, 640 may be provided on the head holder, in place of being provided on the carriage 32, 624 as in the illustrated embodiments.

In the first embodiment shown in FIGS. 1–10, the two upper projections 164 are provided so as to be engageable with the two receiving portions 150, respectively, on both sides of the ink outlet 162 and the connecting device 142 in the holder-movement direction. The two projections 164 may be replaced by a single projection which projects frontward from a middle portion of the front surface of the ink container 82 and extends in the direction of width of the same 82. In the latter case, the two receiving portions 150 may, or may not, be replaced by a single projection which projects rearward from a middle portion of the rear surface of the front wall 90 of the head holder 80 and extends in the direction of width of the same 80. Alternatively, the two projections 164 and/or the two receiving portions 150 may, or may not, be replaced by three or more projections and/or three or more receiving portions, respectively.

In the case where the two projections 164 and/or the two receiving portions 150 are replaced by a single projection and/or a single receiving portion, positioning projections are provided adjacent either the projection or projections or the receiving portion or portions, so as to position, while the ink container 82 is rotated relative to the head holder 80, the ink container 82 in the direction parallel to the axis line of rotation of the ink container 82 relative to the head holder 80.

In the fourth to sixth embodiments shown in FIGS. 16–22, the two stopper projections 512, 548, 569 which stop the frontward movement of the ink container 480, 522, 560 may be replaced by a single stopper projection which extends in the direction of width of the head holder 488, 530, 572.

The present invention is applicable to a thermal ink jetting apparatus wherein a heat generator which is provided in an ink flow passage is operated to heat the air and thereby jet the ink toward a recording medium.

Moreover, the present invention is applicable to an ink jetting apparatus which jets ink in a vertical direction or an oblique direction different from the horizontal direction, or an ink cartridge for use with the latter ink jetting apparatus.

Furthermore, the present invention may be embodied by combining one or more of the structural elements of each of the illustrated embodiments, with the structural elements of another or other embodiments.

In the illustrated embodiments, the cartridge may include, in addition to the ink container 82, 430, 460, 480, 522, 560, 622, 642, an ink jetting head and/or a casing which accommodates the ink container and/or supports the ink jetting head. The head holder 80, 436, 464, 488, 530, 572 functions as the cartridge holder which holds the cartridge.

The upper surface 147, 438, 504, 588 of the bottom wall 86, 438, 502, 550, 586, or the front surface of the rear wall 440, of the head holder 80, 436, 464, 488, 530, 572 provides a first cartridge-side surface; the rear surface 92 of the front wall 90, 496, 540, 578 of the head holder provides a second cartridge-side surface; the lower or rear surface 169, 432 of the ink container 82, 430, 460, 480, 522, 560, 622, 642 provides a first holder-side surface; and the front surface 160, 484, 524 of the ink container provides a second holder-side surface. The positioning-related engageable projection 154, 434 provides a first engageable projection; the positioning-related engageable recess 178, 442 provides a first engageable hole; the lower or guide projections 166, 486, 520, 568 of the ink container provide second engageable projections; and the engageable recesses 144, 500, 544, 584 provide second engageable recesses.

It is to be understood that the present invention may be embodied with other changes, improvements, and modifications that may occur to those skilled in the art without departing from the scope and spirit of the invention defined in the appended claims.

What is claimed is:

1. An ink jetting apparatus comprising:

at least one cartridge including at least an ink container which contains an ink therein;

at least one movable cartridge holder to which said cartridge is detachably attached; and a moving device which moves said cartridge holder, said cartridge holder having a first cartridge-side surface which extends substantially parallel to a direction of movement of the cartridge holder by said moving device, said cartridge having a first holder-side surface which is opposed to said first cartridge-side surface, said cartridge holder having, in said first cartridge-side surface thereof, one of a first engageable projection and a first engageable hole, said cartridge having, in said first holder-side surface thereof, the other of said first engageable projection and said first engageable hole, said first engageable projection and said first engageable hole having respective shapes and respective dimensions which ensure that while the first engageable projection is engaged with the first engageable hole, said cartridge is substantially immovable relative to said cartridge holder in said direction of movement of the cartridge holder.

2. An apparatus according to claim 1, wherein said cartridge holder has a second cartridge-side surface which extends substantially parallel to said direction of movement thereof, and said cartridge has a second holder-side surface which is opposed to said second cartridge-side surface, the cartridge holder having, in the second cartridge-side surface thereof, one of a second engageable projection and a second engageable hole, the cartridge having, in the second holder-side surface thereof, the other of said second engageable projection and said second engageable hole, said second engageable projection and said second engageable hole having respective shapes and respective dimensions which ensure that while the second engageable projection is engaged with the second engageable hole, the cartridge is substantially immovable relative to the cartridge holder in said direction of movement thereof.

3. An apparatus according to claim 2, wherein said first engageable projection and hole are located away from said second engageable projection and hole in a perpendicular direction perpendicular to the movement direction of said cartridge holder.

4. An apparatus according to claim 3, wherein a distance between said first engageable projection and hole and said second engageable projection and hole in said perpendicular direction is greater than a dimension of said cartridge in said movement direction.

5. An apparatus according to claim 1, wherein said cartridge holder comprises an ink-jetting head which jets said ink supplied from said ink container of said cartridge.

6. An apparatus according to claim 1, wherein said first engageable projection has a part-cylindrical top surface and extends in a direction perpendicular to the movement direction of said cartridge holder.

7. An apparatus according to claim 1, wherein said first engageable hole has a part-cylindrical bottom surface and extends in a direction perpendicular to the movement direction of said cartridge holder.

8. An apparatus according to claim 1, wherein said first engageable projection and hole are located at respective middle positions of said cartridge holder and said cartridge in the movement direction of said cartridge holder.

9. An apparatus according to claim 2, wherein said first engageable hole is provided in said first holder-side surface of said cartridge, and said second engageable projection is provided in said second holder-side surface of the cartridge.

10. An apparatus according to claim 2, wherein said cartridge holder comprises:

an ink-jetting head which jets said ink supplied from said ink container of said cartridge detachably attached to the cartridge holder;

a head supporting portion which supports said ink-jetting head;

a connecting device which is supported by said head supporting portion and which connects between said ink-jetting head and an ink outlet of said ink container of said cartridge; and a cartridge holding portion which extends from said head supporting portion in a first plane intersecting a second plane in which the head supporting portion extends and which holds said cartridge such that the cartridge is detachable from the cartridge holder.

11. An apparatus according to claim 10, wherein said first cartridge-side surface comprises a cartridge-side surface of said cartridge holding portion of said cartridge holder which surface is opposed to said cartridge, and said second cartridge-side surface comprises a cartridge-side surface of said head supporting portion of the cartridge holder which surface is opposed to the cartridge.

12. An apparatus according to claim 10, wherein a distance between said head supporting portion and said first engageable projection and hole in a direction in which said cartridge holding portion extends from the head supporting portion is larger than a dimension of said cartridge in the movement direction of said cartridge holder.

13. An apparatus according to claim 11, wherein said second engageable hole has an inner dimension in a perpendicular direction perpendicular to the movement direction of said cartridge holder and a direction of jetting of said ink by said ink-jetting head, said inner dimension decreasing in a direction of depth of the second engageable hole from an opening thereof through which said second engageable projection is engageable therewith.

14. An apparatus according to claim 13, wherein said second engageable hole is provided in said cartridge-side surface of said head-supporting portion of said cartridge holder, and has a side wall surface which is continuous with said cartridge-side surface of said cartridge holding portion of the cartridge holder and is inclined with respect to the cartridge-side surface of the cartridge holding portion so as to gradually climb up in said perpendicular direction.

15. An apparatus according to claim 1, further comprising:

a carriage which is movable by said moving device; and a clamping device which clamps said cartridge holder to said carriage such that the cartridge holder is detachable from the carriage.

16. An apparatus according to claim 10, wherein said second engageable projection comprises two projections which laterally project from two side surfaces adjacent to said first and second holder-side surfaces of said cartridge and extend over the second holder-side surface toward said head supporting portion of said cartridge holder.

17. An apparatus according to claim 1, wherein said at least one cartridge comprises a plurality of cartridges, and said at least one movable cartridge holder comprises a plurality of movable cartridge holders to which said cartridges are detachably attached, respectively, and which are mounted on said moving device such that an array of said cartridge holders extends parallel to a direction of movement thereof by the moving device, each of said cartridge holders having said one of said first engageable projection and hole which is provided in said first cartridge-side surface thereof at a corresponding one of a plurality of different first positions in said direction of movement, each of said cartridges including said other of said first engageable projection and hole which is provided in said first holder-side surface thereof at a corresponding one of a plurality of different second positions in said direction of movement which correspond to said first positions, respectively.

18. An apparatus according to claim 1, wherein said at least one cartridge comprises a plurality of cartridges which are respectively detachably attached to a plurality of cartridge holding portions of said movable cartridge holder which is mounted on said moving device, each of said cartridge holding portions of the cartridge holder having said one of said first engageable projection and hole which is provided at a corresponding one of a plurality of different first positions in said direction of movement of the cartridge holder, each of said cartridges including said other of said first engageable projection and hole which is provided in said first holder-side surface thereof at a corresponding one of a plurality of different second positions in said direction of movement which correspond to said first positions, respectively.

19. A cartridge for use with an ink-jetting apparatus, the cartridge including at least an ink container containing an ink therein, and being detachably attached to a cartridge holder which is moved by a moving device along a surface of a recording medium, the cartridge holder having a first cartridge-side surface extending substantially parallel to a direction of movement of the cartridge holder by the moving device, the cartridge holder having, in the first cartridge-side surface thereof, one of a first engageable projection and a first engageable hole, wherein the improvement comprises:

the cartridge having a first holder-side surface which is opposed to the first cartridge-side surface of the cartridge holder, the cartridge including, in said first holder-side surface thereof, the other of said first engageable projection and said first engageable hole.

20. A cartridge according to claim 19, wherein, in the case where the cartridge holder has a second cartridge-side surface which extends substantially parallel to the direction of movement of the cartridge holder, and has, in the second cartridge-side surface thereof, one of a second engageable projection and a second engageable hole, the cartridge has a second holder-side surface which is opposed to the second cartridge-side surface of the cartridge holder, and has, in said second holder-side surface thereof, the other of said second engageable projection and said second engageable hole.

21. A cartridge according to claim 20, wherein said first engageable projection and hole are located away from said second engageable projection and hole in a perpendicular direction perpendicular to the movement direction of the cartridge holder.

22. A cartridge according to claim 21, wherein a distance between said first engageable projection and hole and said second engageable projection and hole in said perpendicular direction is greater than a dimension of the cartridge in said movement direction.

23. A cartridge according to claim 19, wherein said first engageable projection has a part-cylindrical top surface and extends in a direction perpendicular to the movement direction of said cartridge holder.

24. A cartridge according to claim 19, wherein said first engageable hole has a part-cylindrical bottom surface and extends in a direction perpendicular to the movement direction of said cartridge holder.

25. A cartridge according to claim 19, wherein said first engageable projection and hole are located at respective middle positions of the cartridge holder and the cartridge in the movement direction of the cartridge holder.

26. A cartridge according to claim 20, wherein said first engageable hole is provided in said first holder-side surface of the cartridge, and said second engageable projection is provided in said second holder-side surface of the cartridge.

27. A cartridge according to claim 20, wherein, in the case where the cartridge holder includes a cartridge holding portion holding the cartridge such that the cartridge is detachable from the cartridge holder, and a head supporting portion supporting an ink-jetting head which jets said ink supplied from said ink container of the cartridge, said first holder-side surface is opposed to a cartridge-side surface of the cartridge holding portion of the cartridge holder and said second holder-side surface is opposed to a cartridge-side surface of the head supporting portion of the cartridge holder.

28. A cartridge according to claim 20, wherein said second engageable projection extends over said second holder-side surface toward the cartridge holder.

29. A cartridge according to claim 20, wherein said second engageable projection comprises two projections provided at opposite end portions of said second holder-side surface of the cartridge in the movement direction of the cartridge holder.

30. A cartridge according to claim 27, wherein said second engageable projection is provided at one of opposite end portions of said second holder-side surface of the cartridge in a direction perpendicular to the movement direction of the cartridge holder, said one end portion being nearer to the cartridge-side surface of the cartridge holding portion of the cartridge holder, than the other end portion.

31. A cartridge according to claim 20, wherein one of opposite surfaces of said second engageable projection which is opposed to the second cartridge-side surface of the cartridge holder is flush with said first holder-side surface of the cartridge which is opposed to the first cartridge-side surface of the cartridge holder.

32. A cartridge according to claim 27, wherein the cartridge comprises at least one abutable projection projecting from said first holder-side surface thereof which is opposed to the cartridge-side surface of the cartridge holding portion of the cartridge holder, said abutable projection being abutable on the cartridge-side surface of the cartridge holding portion, a projection amount of said abutable projection from said first holder-side surface of the cartridge being predetermined such that when said abutable projection is held in abutment on the cartridge-side surface of the cartridge holding portion, one of opposite surfaces of said second engageable projection which surface is opposite to the other surface thereof opposed to the cartridge-side surface of the cartridge holding portion, is substantially flush with a corresponding one of opposite side wall surfaces of said second engageable hole.

33. A cartridge according to claim 27, wherein said second engageable projection comprises two projections which laterally project from two side surfaces adjacent to said first and second holder-side surfaces of the cartridge and extend over the second holder-side surface toward the head supporting portion of the cartridge holder.

34. A combination of a plurality of cartridges each according to claim 19, wherein the improvement comprises:

each of said plurality of cartridges having said other of said first engageable projection and hole which is provided in said first holder-side surface thereof at a corresponding one of a plurality of different positions in the movement direction of the cartridge holder, so that the movement-direction position of said other of said first engageable projection and hole of one of said cartridges is different from the movement-direction position of said other of said first engageable projection and holes of the other, or each of the others, of said cartridges.

* * * * *